US008025123B2

(12) United States Patent
Mabuchi

(10) Patent No.: US 8,025,123 B2
(45) Date of Patent: Sep. 27, 2011

(54) MUFFLER STRUCTURE FOR VEHICLE

(75) Inventor: Tomoki Mabuchi, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 139 days.

(21) Appl. No.: 12/160,731

(22) PCT Filed: Jan. 15, 2007

(86) PCT No.: PCT/JP2007/050403

§ 371 (c)(1),
(2), (4) Date: Jul. 11, 2008

(87) PCT Pub. No.: WO2007/083593

PCT Pub. Date: Jul. 26, 2007

(65) Prior Publication Data

US 2009/0301808 A1 Dec. 10, 2009

(30) Foreign Application Priority Data

Jan. 17, 2006 (JP) ..... 2006-008817

(51) Int. Cl.

| | |
|---|---|
| ***F01N 13/02*** | (2010.01) |
| ***F01N 1/08*** | (2006.01) |
| *F01N 13/00* | (2010.01) |
| *F01N 1/00* | (2006.01) |

(52) U.S. Cl. ..... 181/282; 181/269; 181/272

(58) Field of Classification Search ..... 181/282, 181/251, 249, 255, 265, 268, 269, 272, 275
See application file for complete search history.

(56) References Cited

U.S. PATENT DOCUMENTS

| | | | | | |
|---|---|---|---|---|---|
| 1,403,614 | A | * | 1/1922 | Malsack | 181/254 |
| 2,109,220 | A | * | 2/1938 | Noblitt et al. | 181/266 |
| 2,147,015 | A | * | 2/1939 | Deremer | 181/266 |
| 2,151,470 | A | * | 3/1939 | Hollerith | 181/266 |
| 2,186,062 | A | * | 1/1940 | Berg et al. | 181/266 |
| 2,484,826 | A | * | 10/1949 | Harley | 181/264 |
| 2,484,827 | A | * | 10/1949 | Harley | 181/268 |
| 2,966,955 | A | | 8/1958 | Smith et al. | |
| 3,003,578 | A | * | 10/1961 | Ewashuk | 181/265 |
| 3,194,341 | A | * | 7/1965 | Haag | 181/256 |

(Continued)

FOREIGN PATENT DOCUMENTS

FR 545 978 A 10/1922

(Continued)

OTHER PUBLICATIONS

Korean Notice of Office Action dated Aug. 3, 2010 (w/English-language translation).

(Continued)

*Primary Examiner* — Edgardo San Martin
(74) *Attorney, Agent, or Firm* — Oliff & Berridge, PLC

(57) ABSTRACT

The invention obtains a muffler structure for a vehicle which can suppress an emission sound. In a muffler shell for a muffler for a vehicle, there are formed a peripheral joint in which an upper shell and a lower shell corresponding to a plurality of shell structure portions are joined in respective peripheral joint flanges and, and an inter-isolation chamber joint in which the upper shell and the lower shell are joined in inter-isolation chamber joint flanges and in such a manner as to partition a space positioned in an inner side of the peripheral joint into a plurality of isolation chambers and arranged in parallel in a gas flow direction.

20 Claims, 20 Drawing Sheets

U.S. PATENT DOCUMENTS

| | | | | | |
|---|---|---|---|---|---|
| 3,478,842 | A | * | 11/1969 | Mattie | 181/268 |
| 3,578,107 | A | * | 5/1971 | Everett et al. | 181/232 |
| 3,650,354 | A | * | 3/1972 | Gordon | 181/240 |
| 3,677,364 | A | * | 7/1972 | Pawlina | 181/269 |
| 3,972,384 | A | * | 8/1976 | Hoefs | 181/232 |
| 4,011,922 | A | * | 3/1977 | Goplen | 181/272 |
| 4,132,286 | A | * | 1/1979 | Hasui et al. | 181/265 |
| 4,192,404 | A | * | 3/1980 | Nakagawa et al. | 181/272 |
| 4,396,090 | A | * | 8/1983 | Wolfhugel | 181/282 |
| 4,598,791 | A | * | 7/1986 | Bates | 181/264 |
| 4,698,939 | A | * | 10/1987 | Hashish | 451/87 |
| 4,765,437 | A | * | 8/1988 | Harwood et al. | 181/282 |
| 4,901,815 | A | * | 2/1990 | Harwood et al. | 181/282 |
| 4,905,791 | A | | 3/1990 | Garey | |
| 4,949,807 | A | * | 8/1990 | Hirata et al. | 181/240 |
| 5,252,788 | A | * | 10/1993 | Emrick et al. | 181/282 |
| 5,428,194 | A | * | 6/1995 | Emrick et al. | 181/228 |
| 5,581,056 | A | * | 12/1996 | Bellgardt et al. | 181/282 |
| 5,929,398 | A | * | 7/1999 | Amino et al. | 181/272 |
| 5,949,035 | A | * | 9/1999 | Herold | 181/282 |
| 6,076,632 | A | * | 6/2000 | Schuhmacher et al. | 181/282 |
| 6,241,044 | B1 | * | 6/2001 | Nishiyama et al. | 181/272 |
| 6,257,367 | B1 | * | 7/2001 | Allman | 181/282 |
| 6,457,553 | B1 | * | 10/2002 | Goplen et al. | 181/272 |
| 6,651,773 | B1 | * | 11/2003 | Marocco | 181/270 |
| 6,681,889 | B2 | | 1/2004 | Collmer et al. | |
| 7,032,709 | B2 | * | 4/2006 | Hoche et al. | 181/268 |
| 7,282,185 | B2 | * | 10/2007 | Harris | 422/181 |
| 7,377,359 | B2 | * | 5/2008 | Hofmann et al. | 181/275 |
| 2005/0224283 | A1 | * | 10/2005 | Yokoi et al. | 181/268 |
| 2006/0283661 | A1 | * | 12/2006 | Tanaka et al. | 181/269 |
| 2007/0045041 | A1 | * | 3/2007 | Krueger et al. | 181/249 |
| 2007/0095606 | A1 | * | 5/2007 | Grandmougin | 181/269 |
| 2007/0284186 | A1 | * | 12/2007 | Thayer et al. | 181/232 |

FOREIGN PATENT DOCUMENTS

| | | | |
|---|---|---|---|
| GB | 1071382 | | 6/1967 |
| JP | 61038114 | A * | 2/1986 |
| JP | A 03-37320 | | 2/1991 |
| JP | A 2002-201926 | | 7/2002 |
| JP | A 2004-11447 | | 1/2004 |
| JP | A-2004-502066 | | 1/2004 |
| JP | A 2004-245052 | | 9/2004 |
| JP | A 2005-16494 | | 1/2005 |
| KR | 0128316 | | 11/1998 |
| KR | 10-0373736 | | 6/2003 |

OTHER PUBLICATIONS

May 16, 2011 European Search Report issued in European Patent Application No. 07706737.9.

May 24, 2011 Office Action issued in Japanese Patent Application No. 2007-554878 (with English Translation).

* cited by examiner

MUFFLER STRUCTURE FOR VEHICLE

TECHNICAL FIELD

The present invention relates to a muffler structure for a vehicle attached to the vehicle.

RELATED ART

As a muffler applied to an exhaust system of an automobile, there has been known a flat muffler in which a dimension in a vertical direction of a vehicle body is smaller than a dimension in a vehicle width direction (see, for example, Japanese Patent Application Laid-Open (JP-A) No. 2004-245052, No. 2002-201826).

DISCLOSURE OF THE INVENTION

Problem to be Solved by the Invention

However, in the conventional flat muffler as mentioned above, since a rigidity of upper and lower flat surfaces extending along a longitudinal direction of a flat cross section is relatively low, there is a risk that an emission sound generated in the flat surface becomes loud.

Consideration has been made of the above points and an object of the present invention is to provide a muffler structure for a vehicle which can suppress an emission sound.

Method of Solving the Problem

A muffler structure for a vehicle of a first aspect of the present invention includes:

an upper shell that has a plurality of outer walls formed in such a manner as to be open to a downward side in a vertical direction of a vehicle body and having a longitudinal axis in a gas flow direction; and a lower shell that has a plurality of outer walls formed in such a manner as to be open to an upward side in the vertical direction of the vehicle body and having a longitudinal axis in the gas flow direction, wherein the upper shell and the lower shell are directly joined at respective peripheral edge portions and a portion between the plurality of outer walls, to thereby form a plurality of isolation chambers which are arranged in parallel to a direction that crosses the gas flow direction By the above aspect, the upper shell and the lower shell are structured such that a plurality of outer walls which have a longitudinal axis in the gas flow direction are bulged out, and the peripheral edge portion and the portion between a plurality of outer walls are joined by confronting the open ends with each other, thereby forming a plurality of isolation chambers partitioned by the joint portion (the inter-isolation chamber joint) between the outer walls in an inner side of the joined portion (the peripheral joint) in the peripheral edge. A plurality of isolation chambers are made long along the gas flow direction and are arranged in parallel to the direction that crosses the longitudinal direction. Accordingly, in accordance with present muffler structure, since an intermediate portion in the parallel direction of the isolation chambers (the longitudinal direction of the flat cross section) is reinforced by the inter-isolation chamber joint while forming the flat shape in which the dimension in the vertical direction of the vehicle body is smaller than the dimension in the parallel direction of each of the isolation chambers as a whole, in other words, since the muffler structure is formed as the flat shape as a whole by arranging the isolation chambers (the closed cross sections) each having a small flatness in parallel, a surface rigidity of the upper and lower shells is secured.

In this manner, the muffler structure for a vehicle of the above described aspect can suppress the emission sound. Further, on the basis of the structure in which the upper shell and the lower shell are joined, there may be obtained the muffler structure for the vehicle in which the emission sound is suppressed by using the upper shell and the lower shell, for example, formed by a press working in which a draw depth is suppressed. Further, on the basis of the structure in which the upper shell and the lower shell are directly joined in accordance with the peripheral joint and the inter-isolation chamber joint, for example, the peripheral joint and the inter-isolation chamber joint may be constructed (joined) by the same operation.

A muffler structure for a vehicle of a second aspect of the present invention includes:

an upper shell having an outer wall formed longitudinally in a gas flow direction and formed so as to be open to a downward side in a in a vertical direction of a vehicle body;

a lower shell having an outer wall formed longitudinally in the gas flow direction and formed so as to be open to an upward side in the vertical direction of a vehicle body, and having a peripheral edge portion joined to a peripheral edge of the upper shell and forming a closed space at an inner side of the joint portion; and a pipe member formed longitudinally in the gas flow direction, joined to each of the outer wall of the upper shell and the outer wall of the lower shell, and partitioning the closed space into a plurality of isolation chambers which are arranged in parallel to a direction that crosses the gas flow direction.

By the above aspect, each of the upper shell and the lower shell is structured such that one or a plurality of outer walls which are formed long in the gas flow direction are evaginated, the peripheral edge portions are joined by confronting the open ends with each other, and each of the outer walls is joined to the pipe member, thereby forming a plurality of isolation chambers partitioned by the pipe member in the inner side of the joined portion (the peripheral joint) in the peripheral edge. A plurality of isolation chambers are formed long along the as flow direction and are arranged in parallel to the direction that crosses the longitudinal direction. Accordingly, in accordance with the present muffler structure, since the intermediate portion in the parallel direction of the isolation chambers (the longitudinal direction of the flat cross section) is reinforced by the joined position (the inter-isolation chamber joint) between the outer wall and the pipe member while forming the flat shape in which the dimension in the vertical direction of the vehicle body is smaller than the dimension in the parallel direction of each of the isolation chambers as a whole, in other words, since the muffler structure is formed as the flat shape as a whole by arranging the isolation chambers (the closed cross sections) each having the cross sectional shape having the small flatness in parallel, a surface rigidity of the upper and lower shells is secured.

In this manner, the muffler structure for a vehicle of the above described aspect can suppress the emission sound. Further, in the prevent muffler structure for the vehicle, since a plurality of isolation chambers are formed by joining the outer walls of the upper end lower shells to the hollow pipe member, in other words, since the isolation chambers surrounded by the upper and lower shells and the pipe member are formed in both sides sandwiching the pipe member (the isolation chamber), the muffler capacity may be enlarged without increasing a whole thickness, in the structure having the inter-isolation chamber joint serving as the reinforcing portion for suppressing the emission sound. Further, on the basis of the structure in which the upper shell and the lower shell are joined, there may be obtained the muffler structure for the vehicle in which the emission sound is suppressed by using the upper shell and the lower shell, for example, formed by a press working in which a draw depth is suppressed.

In the above aspect, it is preferable that a part of a plate-shaped separator partitioning the isolation chamber formed at an outer side of the pipe member in the gas flow direction is protruded to the isolation chamber within the pipe member.

By the above aspect, since a part of the separator partitioning the different isolation chamber from the isolation chamber constructed by the pipe member in the gas flow direction is protruded to the isolation chamber within the pipe member, (the dimension, the shape and the like of) the protruding portion may be used as a tuning element for reducing an exhaust sound (mainly a pulsation sound). In other words, in the present muffler structure for the vehicle, since the tuning element for reducing the exhaust sound is increased, and a width of the tuning for reducing the exhaust sound is widened, the exhaust sound may be reduced as a whole in conjunction with the suppression of the emission sound on the basis of the improvement of the rigidity (the restriction against the dimension, the shape and the like may be reduced as a whole of the muffler structure for the vehicle demanded for reducing the exhaust sound). Further, the tuning width may be widened without increasing the number of the parts. Accordingly, the tuning may be carried out in such a manner as to effectively reduce the exhaust sound, for example, in a low frequency band.

In the above aspect, it is preferable that the isolation chambers are formed as columnar space.

By the above aspect, since the upper and lower outer walls, or the upper and lower outer walls and the pipe member are formed approximately as a cylindrical shape so as to construct the columnar isolation chamber, a cross sectional circumferential length (a circumference) with respect to the capacity of the isolation chamber becomes small, and the surface rigidity becomes higher. Accordingly, the emission sound may be effectively suppressed.

In the above aspect, it is preferable that the muffler structure comprises a communicating portion that communicates the plurality of isolation chambers.

By the above aspect, since the communicating portion that communicates a plurality of isolation chambers, for example, a plurality of isolation chambers may be used as a continuous gas flow path or a part of the isolation chambers may be used as a resonant chamber. Further, the dimension, the shape, the layout and the like of the communicating portion may be set to the tuning element for reducing the exhaust sound (mainly the pulsation sound) or obtaining a preferable sound quality. A whole of the exhaust sound including the emission sound may be reduced by the tuning.

In the above aspect, it is preferable that the communicating portion that communicates between longitudinal direction end portions of the isolation chambers which are adjacent in a parallel direction.

By the above aspect, since the communicating portion that communicates between the end portions in the longitudinal direction of the isolation chambers, the gas flow path including the series path in which the gas flows through a plurality of isolation chamber while turning back may be structured.

In the above aspect, it is preferable that the communicating portion is provided at a joint position partitioning the plurality of isolation chambers or at the pipe member.

By the above aspect, in the structure in which the upper and lower shells are directly joined so as to construct the inter-isolation chamber joint (the structure in the first aspect), the communicating portion is provided at the inter-isolation chamber joint, and in the structure in which the upper and lower shells are joined to the pipe member so as to construct the inter-isolation chamber joint (the structure in the second aspect), the communicating portion is provided at the pipe member. Accordingly, the communicating portion may be provided on the basis of a simple structure without increasing the thickness of the whole of the muffler structure.

Further, in the former structure, the communicating portion may be utilized as a means for improving the rigidity of the inter-isolation chamber joint (the plate overlapping portion). Particularly, in the structure in which plurality of communicating portions are provided in the gas flow direction, an effect of improving the rigidity becomes high. In these cases, the emission sound may be further suppressed. Further, in any of the former structure and the latter structure, a plurality of communicating portion may be provided, and a plurality of communicating portion may be utilized as a tuning element for suppressing the exhaust sound (mainly the pulsation sound).

In the above aspect, it is preferable that the muffler structure comprises an inner pipe which is located along the gas flow direction within the isolation chamber.

By the above aspect, since the inner pipe is arranged along the gas flow direction within at least one isolation chamber, the inner and outer sides of the inner pipe within the isolation chamber may be used as the different gas flow paths (isolation chambers).

In the above aspect, it is preferable that the inner pipe is supported at each of the upper shell and the lower shell by a support member.

By the above aspect, since the inner pipe is supported at each of a plurality of upper and lower shells through the support member, the rigidity of a plurality of shell structure portions may be increased, and the support rigidity of the inner pipe may be secured.

In the above aspect, it is preferable that the muffler structure comprises a bridging member that bridges between the outer walls constituting different isolation chambers in the upper shell in the parallel direction of the isolation chambers, wherein a muffler support portion coupled to the vehicle body is constructed in the bridging member.

By the above aspect, since the bridging member that bridges the outer walls constructing a plurality of isolation chambers in the upper shell is provided, the rigidity against a deformation of the inter-isolation chamber joint is improved, and each of the isolation chamber may be inhibited from relatively displacing in the parallel direction (a short side direction of a flat cross section). Further, since the muffler support portion is constructed in the high rigidity portion in the muffler structure, a muffler vibration caused by the support to the vehicle body by the muffler support portion may be suppressed.

In the above aspect, it is preferable that the bridging member is joined to the joint position partitioning the plurality of isolation chambers.

By the above aspect, since the bridging member is joined by the portion including three points having the outer walls of the respective isolation chambers and the inter-isolation chamber joint, the rigidity against the support by the muffler support portion becomes further higher, the muffler vibration caused by the support to the vehicle body by the muffler support portion may be more effectively suppressed.

In the above aspect, it is preferable that the bridging member constructing the muffler support portion is arranged at a center of gravity position of the muffler in a plan view.

By the above aspect, since the bridging member, that is, the muffler support portion is provided near the center of gravity point of the muffler in the plan view, a mass (a load) of the muffler is approximately uniformly applied to the muffler support portion, and a deviation of a load applied to the muffler support portion may be suppressed. Accordingly, the muffler vibration caused by the support to the vehicle body by the muffler support portion may be more effectively suppressed.

In the above aspect, it is preferable that a muffler support portion coupled to the vehicle body is provided at a joint position partitioning the plurality of isolation chambers By the above aspect, the muffler structure is supported to the vehicle body through the inter-isolation chamber joint positioned between the isolation chambers. Since the inter-isolation chamber joint corresponds to a high rigidity portion, the muffler support portion may well support. For example, the muffler support portion can suppress the vibration transmission to the vehicle body caused by the muffler retention structure.

Effect of the Invention

As described above, the muffler structure for the vehicle in accordance with the invention has an excellent effect that the emission sound may be suppressed.

BRIEF DESCRIPTION OF THE DRAWINGS

FIG. 9A is a cross sectional view along a line 9'-9B in FIG. 8;

BEST MODE FOR CARRYING OUT THE INVENTION

Explanation will now be given regarding a vehicle muffler 10 as a muffler structure for a vehicle according to a first exemplary embodiment of the present invention, with reference to FIGS. 1 to 4. In this case, in the following description, it is assumed that a direction appropriately indicated by an arrow L in each of the drawings is set to a muffler front-rear direction of the vehicle muffler 10, and as a matter of convenience for explanation, a side shown by Lf in the direction of the arrow L is set to a front side, and a direction shown by Lr is set to a rear side. Further, it is assumed that a direction shown by an arrow UP is set to an upward direction, and a direction shown by an arrow Wm is set to a muffler width direction. Further, in FIG. 4 showing an in-vehicle state of the vehicle muffler 10, it is assumed that a direction shown by an arrow FR is set to a front direction (direction of progression) of vehicle body, and a direction shown by an arrow Wb is set to a vehicle width direction.

Figure 1:
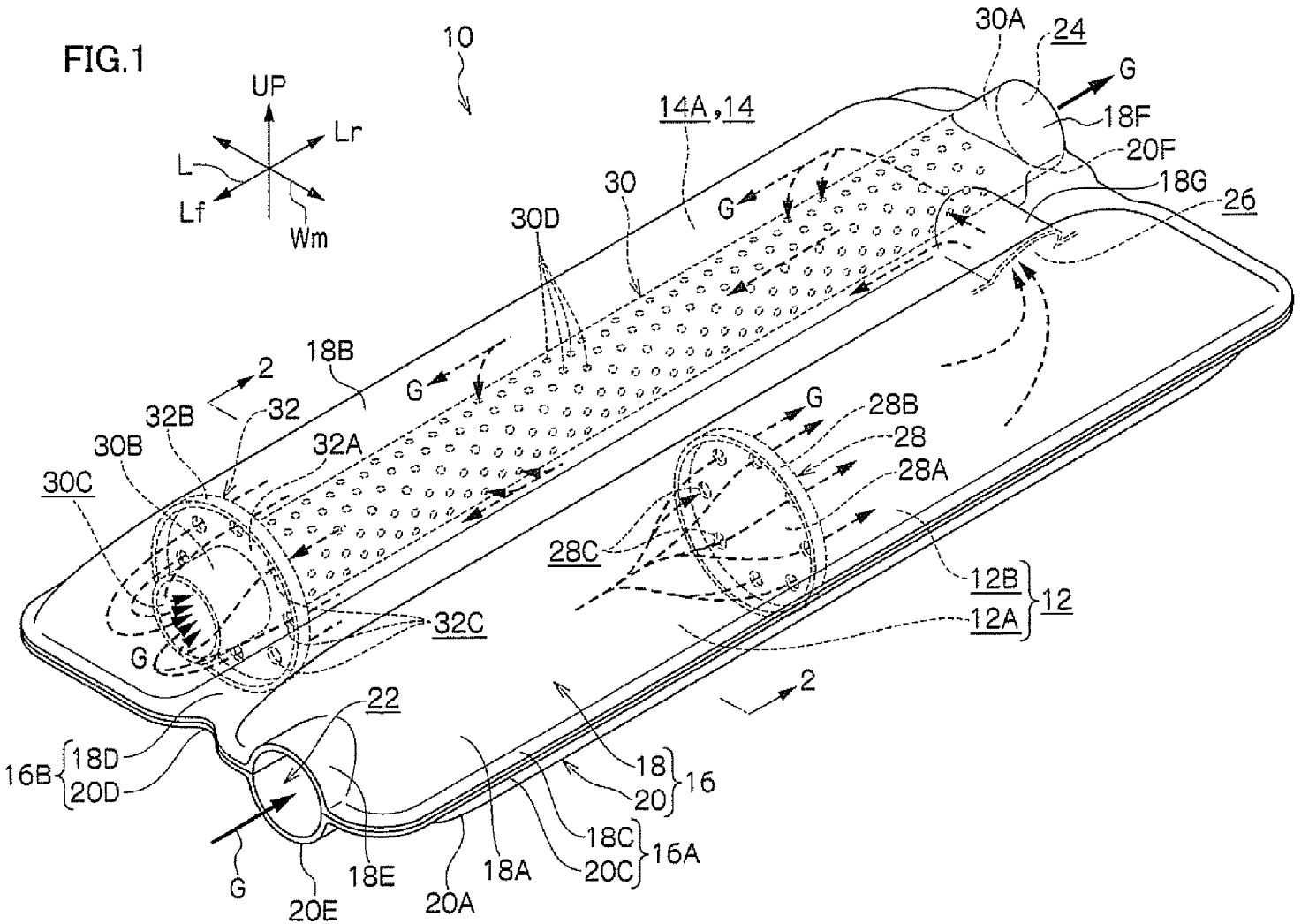
FIG. 1 is a perspective view of a muffler for a vehicle according to a first exemplary embodiment of the present invention.
Figure 2:
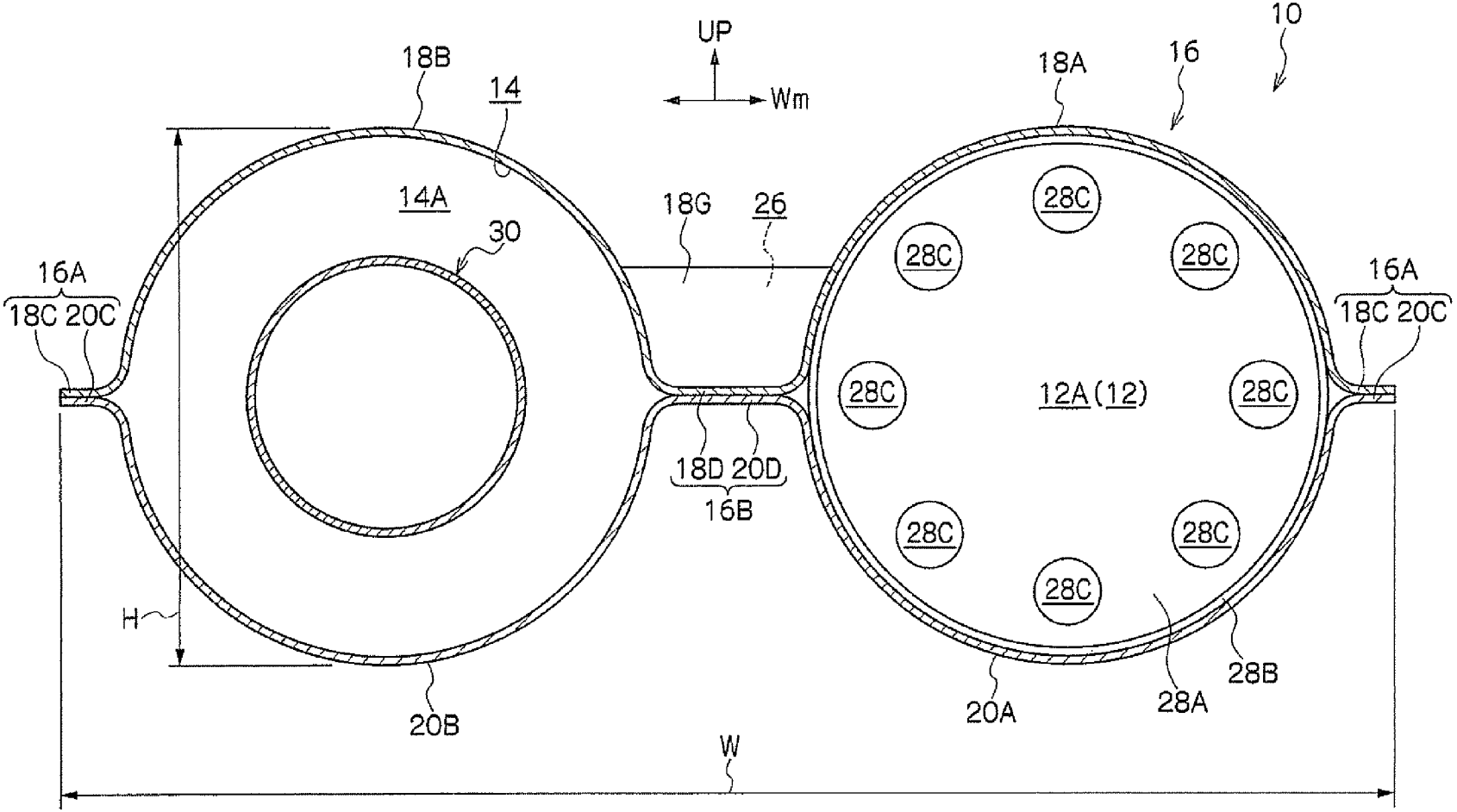
FIG. 2 is a cross sectional view along a line 2-2 in FIG. 1.

A whole structure of the vehicle muffler 10 is shown in FIG. 1 by a perspective view. Further, a cross sectional view along a line 2-2 in FIG. 1 is shown in FIG. 2. As shown in these drawings, the vehicle muffler 10 is structured such as to have a pair of isolation chambers 12 and 14 which have a longitudinal axis in the muffler front-rear direction, and are arranged in parallel in the muffler width direction, and is formed as a whole as a flat shape in which a dimension H in a vertical direction is smaller than a dimension W in the muffler width direction as shown in FIG. 2.

Specifically, a muffler shell 16 forming an outer shell of the vehicle muffler 10 and serving as a muffler main body in which a pair of isolation chambers 12 and 14 are formed at an inner portion are structured by joining an upper shell 18 and a lower shell 20. As shown in FIG. 2, the upper shell 18 is structured such as to have a first outer wall 18A and a second outer wall 18B which are formed as an approximately semi-cylindrical shape being open to a downward side in a cross sectional view being orthogonal to a longitudinal direction and are arranged in parallel in the muffler width direction, a peripheral joint flange 18C formed in such a manner as to surround a periphery of the first outer wall 18A and the second outer wall 18B, and an inter-isolation chamber joint flange 18D formed between the first outer wall 18A and the second outer wall 18B in the muffler width direction. The peripheral joint flange 18C and the inter-isolation chamber joint flange 18D are formed so as to form the same surface along the downward open ends of the first outer wall 18A and the second outer wall 18B.

The lower shell 20 is formed so as to be approximately symmetrical up and down with respect to the upper shell 1S, and is structured such as to have a first outer wall 20A and a second outer wall 20B which are formed as an approximately semi-cylindrical shape being open to an upward direction and are arranged so as to be arranged in parallel in the muffler width direction, a peripheral joint flange 20C formed in such a manner as to surround a periphery of the first outer wall 20A and the second outer wall 20B, and an inter-isolation chamber joint flange 20D formed between the first outer wall 20A and the second outer wall 20B in the muffler width direction.

The muffler shell 16 is structured such that a pair of isolation chambers 12 and 14 partitioned in the muffler width direction by an inter-isolation chamber joint 16B at an inner side of a peripheral joint 16A, due to the peripheral joint 16A being constructed by joining the peripheral joint flange 18C of the upper shell 18 and the peripheral joint flange 20C of the lower shell 20, and the inter-isolation chamber joint 16B being constructed by joining the inter-isolation chamber joint flange 1 SD of the upper shell 18 and the inter-isolation chamber joint flange 20D of the lower shell 20. In this exemplary embodiment, the isolation chamber 12 corresponding to a space within the outer walls 18A and 20A each of which is formed as the semi-cylindrical shape, and the isolation chamber 14 corresponding to a space within the outer walls 18B and 20B each of which is formed as the semi-cylindrical shape are formed as an approximately cylindrical space (having a circular cross section).

As shown in FIG. 1, a gas introduction port 22 to which an exhaust gas is introduced, and a gas discharge port 24 discharging the exhaust gas are formed at the muffler shell 16. The gas introduction port 22 is open to a forward direction in the muffler front-rear direction, and communicates a front end of the isolation chamber 12 with an outside of the muffler shell 16. The gas discharge port 24 is open to a backward direction in the muffler front-rear direction, and communicates a rear end of the isolation chamber 14 with the outside of the muffler shell 16.

The gas introduction port 22 is formed by making non-joined portions between a gas introduction port forming portion 18E of the peripheral joint flange 18C and a gas introduction port forming portion 20E of the peripheral joint flange 20C, the gas introduction port forming portion 18E being a portion positioned at a front side of the first outer wall 18A in the peripheral joint flange 18C of the upper shell 18 and formed as a semi-cylindrical shape which is open downward along a longitudinal direction, and the gas introduction port forming portion 20E being a portion positioned at a front side of the first outer wall 20A in the peripheral joint flange 20C of the lower shell 20 and formed as a semi-cylindrical shape which is open upward along the longitudinal direction.

In the same manner, the gas discharge port 24 is formed by making non-joined portions between a gas discharge port forming portion 18F of the peripheral joint flange 18C and a gas discharge port forming portion 20F of the peripheral joint flange 20C, the gas discharge port forming portion 18F being a portion positioned at a rear side of the second outer wall 18B in the peripheral joint flange 18C of the upper shell 18 and formed as a semi-cylindrical shape which is open downward along the longitudinal direction, and the gas discharge port forming portion 20F being a portion positioned at a rear side of the second outer wall 20B in the peripheral joint flange 20C of the lower shell 20 and formed as a semi-cylindrical shape which is open upward along the longitudinal direction.

Further, a communication path 26 serving as a communicating portion communicating a pair of isolation chambers 12 and 14 is formed at the muffler shell 16. The communication path 26 is formed between a tunnel portion 18G and the inter-isolation chamber joint flange 20D by raising a part of the inter-isolation chamber joint flange 18D in the upper shell 18 so as to form the tunnel portion 18G which is not joined to the inter-isolation chamber joint flange 20D. In this case, a tunnel portion formed approximately symmetrical with the tunnel portion 18G may be provided at the lower shell 20 side. In this exemplary embodiment, the communication path 26 communicates between portions near rear end portions of a pair of isolation chambers 12 and 14.

Each of the upper shell 18 and the lower shell 20 described above is integrally formed in respective portions by a press working of a metal thin plate. Further, the upper shell 18 and the lower shell 20 may be structured by making the portions alone the muffler longitudinal direction in the peripheral joint flange 18C and the peripheral joint flange 20C common (integral) and folding back the common portion. In this case, the upper shell 18 and the lower shell 20 may be integrally (simultaneously) formed. In this case, the upper shell 18 corresponds to the upper shell or the cover body in the present invention, and the lower shell 20 corresponds to the lower shell or the cover body in the present invention.

Further, a separator 28 partitioning the isolation chamber 12 back and forth is arranged within the isolation chamber 12 of the muffler shell 16. The separator 28 is structured such as to have a disc-like partition plate portion 28A partitioning the isolation chamber 12 back and forth, and a ring-shaped fitting portion 28B provided at the partition plate portion 28A so as to be extended from a peripheral edge, and a plurality of through holes 28C allowing an exhaust gas to pass are formed in the partition plate portion 28A. The fitting portion 28B fitted to an inner circumference (the first outer walls 18A and 20A) of the isolation chamber 12 is fixed to the inner circumference of the isolation chamber 12 by a welding or the like, whereby the separator 28 is retained with respect to the muffler shell 16.

The separator 28 is structured (a dimension, a number, a layout and the like of the through hole 28C are set) such that a contraction flow and an expansion are generated in a gas flow passing through a plurality of through holes 28C, and a noise reduction effect (mainly an effect of reducing a pulsation sound) may be obtained. In this exemplary embodiment, the through holes 28C are arranged at a uniform interval on a virtual circumference which is concentric with the isolation chamber 12. Hereinafter, a space in a front side of the separator 28 in the isolation chamber 12 is called as a first expansion chamber 12A, and a space in a rear side of the separator 28 is called as a second expansion chamber 12B.

Further, an inner pipe 30 is arranged within the isolation chamber 14 of the muffler shell 16. The inner pipe 30 is formed long along the muffler front-rear direction and is arranged in an axial portion of the isolation chamber 14. A rear end portion 30A of the inner pipe 30 is fitted to the gas discharge port 24, and a front end portion 30B thereof is fitted to a separator 32 serving as a support member near a front end of the isolation chamber 14, whereby the inner pipe 30 is retained to the muffler shell 16. The separator 32 is structured such as to have an annular support plate portion 32A coupling an outer circumferential surface of the inner pipe 30 and an inner circumferential surface of the isolation chamber 14, and a ring-shaped fitting portion 32B provided at the support plate portion 32A so as to be extended from a peripheral edge, and a plurality of through holes 32C allowing the exhaust gas to pass are formed at the support plate portion 32A.

The through holes 32C are arranged at a uniform interval on a virtual circumference which is concentric with the isolation chamber 14, and a dimension, a number, a layout and the like are set so as to generate a pressure balance by which a part of the exhaust gas passes through a plurality of gas holes 30D described below. The fining portion 32B fitted to the inner circumference (the second outer walls 18B and 20B) of the isolation chamber 14 is fixed to the inner circumference of the isolation chamber 14 by a welding or the like, whereby the separator 32 is retained to the muffler shell 16.

Further, the inner pipe 30 passes through a through hole 32D formed at an axial portion of the support plate portion 32A, and an opening portion 30C in the front end portion 30B side is open in a front side of the support plate portion 32A. Further, a lot of gas holes 30D passing through the pipe wall are formed at an intermediate portion between the rear end portion 30A and the front end portion 30B in the inner pipe 30. A dimension, a number, a layout and the like of a lot of gas holes 30D are set such as to absorb (damp) a sound energy (an exhaust gas pulsation) of the passing exhaust gas. Hereinafter, a space in an outer side of the inner pipe 30 in the isolation chamber 14 is called as a third expansion chamber 14A.

In the vehicle muffler 10 described above a configuration is provided such that the exhaust gas introduced to the isolation chamber 12 from the gas introduction port 22 is reaches the second expansion chamber 12B by passing through the through holes 28C of the separator 28 from the first expansion chamber 12A, and is introduced to the third expansion chamber 14A by passing through the communication path 26, as shown by an arrow G in FIG. 1. Further, a part of the exhaust gas introduced to the isolation chamber 14 is directly introduced into the inner pipe 30 through a lot of gas holes 30D, and the residual part thereof is structured such as to be introduced into the inner pipe 30 from the opening portion 30C through the through hole 32C of the separator 32, and be discharged to an outside (an exhaust pipe) from the gas discharge port 24 (the rear end portion 30A) through the inner pipe 30.

As shown in FIG. 4, in this exemplary embodiment, the vehicle muffler 10 is arranged such that a longitudinal direction (a front-rear direction) is inclined with respect to the vehicle front-rear direction in a plan view. A rear end of the inlet pipe 34 serving as the exhaust pipe in which a front end (the exhaust gas upstream end) is connected to an exhaust manifold of an internal combustion engine (not shown) is connected to the gas introduction port 22. A catalyst converter 36 is arranged in an intermediate portion of the inlet pipe 34. On the other hand, a front end of an outlet pipe 38 serving as an exhaust pipe in which a rear end (an exhaust gas-downstream end) is open to an atmospheric air is connected to a gas discharge port 24 (the rear end portion 30A of the inner pipe 30).

In this exemplary embodiment, the vehicle muffler 10, the inlet pipe 34 including the catalyst converter 36, and the outlet pipe 38 construct an exhaust system 40 which is integrally supported to the vehicle body (integrally assembled). A muffler support 42 provided in the vehicle muffler 10, and a support rod (not shown) provided at the outlet pipe 38 are connected to a support rod in the vehicle body side through a support rubber 44, whereby the exhaust system 40 is supported to the vehicle body. A center of gravity point Ge of the exhaust system 40 is positioned on a virtual straight line L3 connecting support points at two positions in a plan view. Accordingly, the exhaust system 40 is suspended to the vehicle body so as to keep a predetermined posture.

Figure 3A:
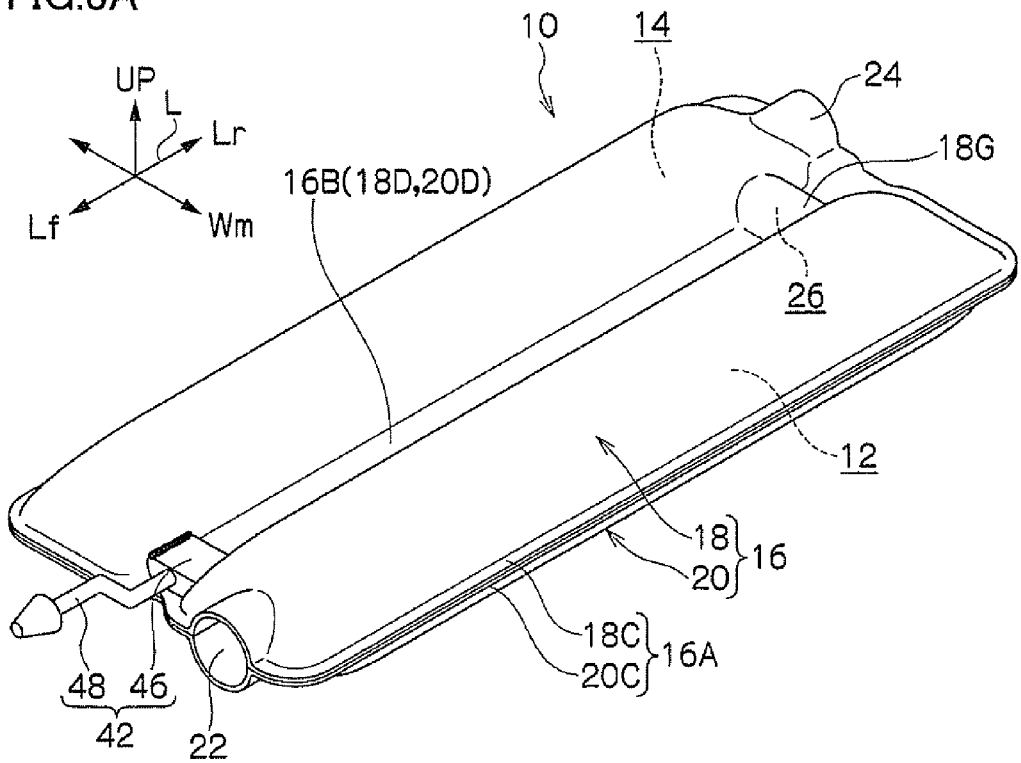
FIG. 3A is a perspective view showing a support structure of the muffler for the vehicle according to a first exemplary embodiment of the present invention.
Figure 3B:
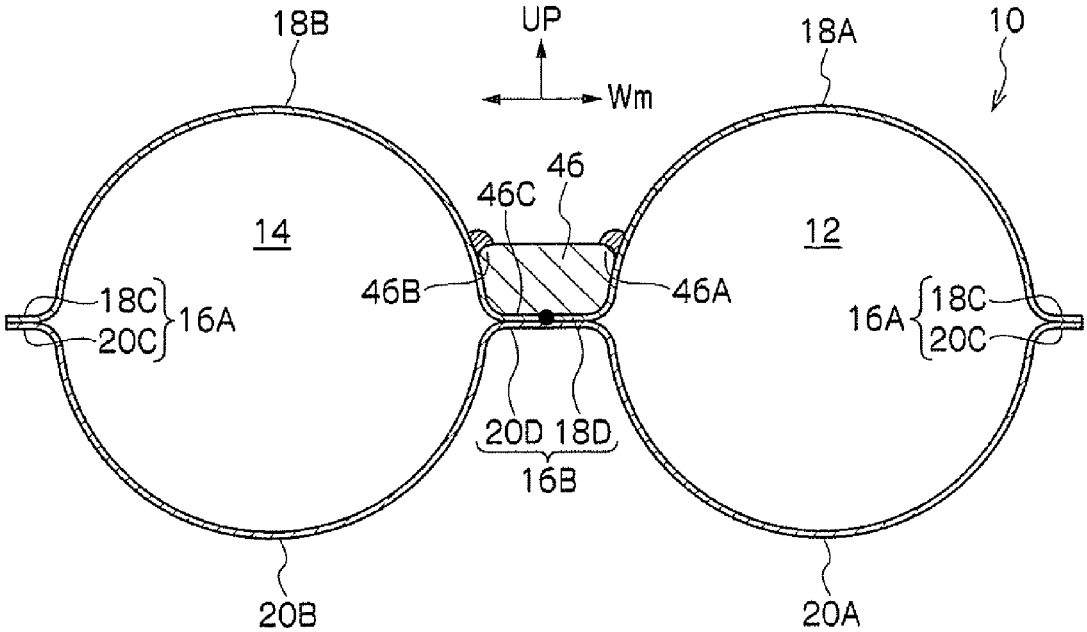
FIG. 3B is an enlarged cross sectional view of a main portion showing the support structure of the muffler for the vehicle according to the first exemplary embodiment of the present invention.
Figure 4:
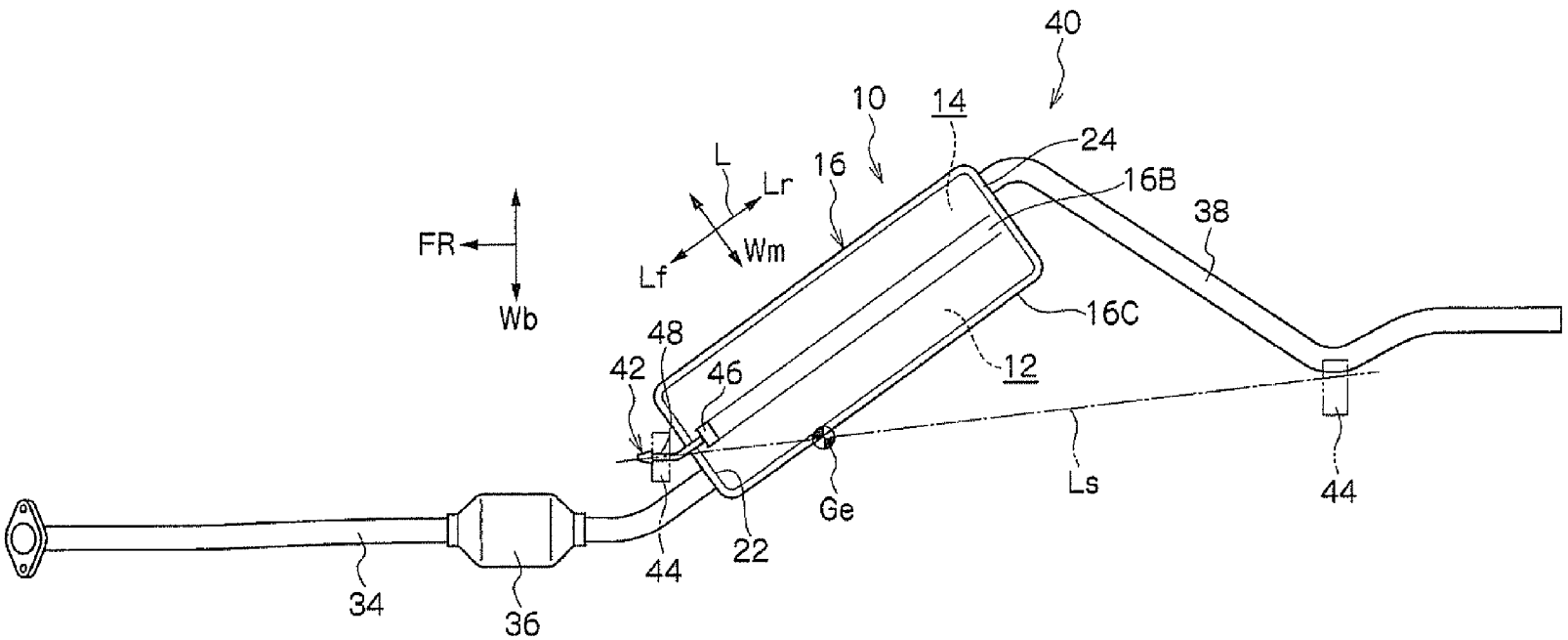
FIG. 4 is a plan view showing a support state of an exhaust system including the muffler for the vehicle according to the first exemplary embodiment of the present invention.

As shown in FIG. 3A, the muffler support 42 is provided near a front end of the inter-isolation chamber joint 16B in the vehicle muffler 10. Specifically, the muffler support 42 is structured such as to include a base portion 46 fixed to the inter-isolation chamber joint 16B, and a rod portion 48 extended from the base portion 46. As shown in FIG. 3B, the base portion 46 is structured such that both upper corner portions 46A and 46B of the end portion in the muffler width direction are fixed to the first outer wall 18A and the second outer wall 18B respectively by an arc welding (a fillet welding) in such a manner as to bridge the first outer wall 18A (the isolation chamber 12) and the second outer wall 18B (the isolation chamber 14). Further, the base portion 46 is structured such that a bottom portion 46C is joined to the inter-isolation chamber joint 16B (the inter-isolation chamber joint flanges 18D and 20D) by a laser welding. Accordingly, the base portion 46 corresponds to the bridging member in the invention.

The rod portion 48 is extended to the front side of the muffler from the base portion 46, and protrudes to the front side than the front end of the vehicle muffler 10 (the muffler shell 16). The rod portion 48 is approximately bent or curved in such a manner that the center of gravity point Ge of the exhaust system 40 is positioned on the virtual straight line Ls mentioned above.

Explanation will now be given of the operation of the present exemplary embodiment.

In the vehicle muffler 10 having the structure mentioned above, the exhaust gas introduced from the inlet pipe 34 is expanded in the first expansion chamber 12A, generates the contraction flow at a time of passing through the through hole 28C of the separator 28, and is again expanded in the second expansion chamber 12B. Further, the exhaust gas generates the contraction flow in the communication path 26 and is expanded in the their expansion chamber 14A, and a part of the exhaust gas passes through a lot of gas holes 30D of the inner pipe 30, thereby being introduced to the inner pipe 30 while a sound energy being absorbed, and the residual part of the exhaust gas is introduced to the inner pipe 30 from the opening portion 30C through holes 32C of the separator 32. Further, the exhaust gas introduced to the inner pipe 30 is discharged to the outlet pipe 38 through the rear end portion 30A of the inner pipe 30, that is, the gas discharge port 24, and is released into the atmosphere from the output pipe 38.

In this case, in the vehicle muffler 10, since two isolation chambers 12 and 14 isolated by the inter-isolation chamber joint 16B are arranged in parallel in the muffler width direction, a flat surface having low rigidity is not formed while the dimension H in the vertical direction is smaller than the dimension W in the muffler width direction as a whole. In other words, the inter-isolation chamber joint 16B intermittently or continuously joined over approximately the whole length in the longitudinal direction of the muffler shell 16 reinforces the muffler shell 16. Accordingly, a surface rigidity in each of the portions (the first outer walls 18A and 20A and the second outer walls 18B and 20B constructing the isolation chambers 12 and 14) of the muffler shell 16 is secured. Therefore, in the vehicle muffler 10, an emission sound generated together with the passing of the exhaust gas is suppressed.

Particularly, in the vehicle muffler 10, since the isolation chambers 12 and 14 are formed as the approximately columnar shape, a circumferential length per volume (muffler capacity) of the isolation chambers 12 and 14 is short in a cross sectional view which is orthogonal to the longitudinal direction. Accordingly, since the rigidities of the respective portions of the first outer walls 18A and 20A and the second outer walls 18B and 20B constructing the isolation chambers 12 and 14 become approximately uniform, in other words, since a partly low rigidity portion is not formed, the emission sound is effectively suppressed.

Figure 20B:
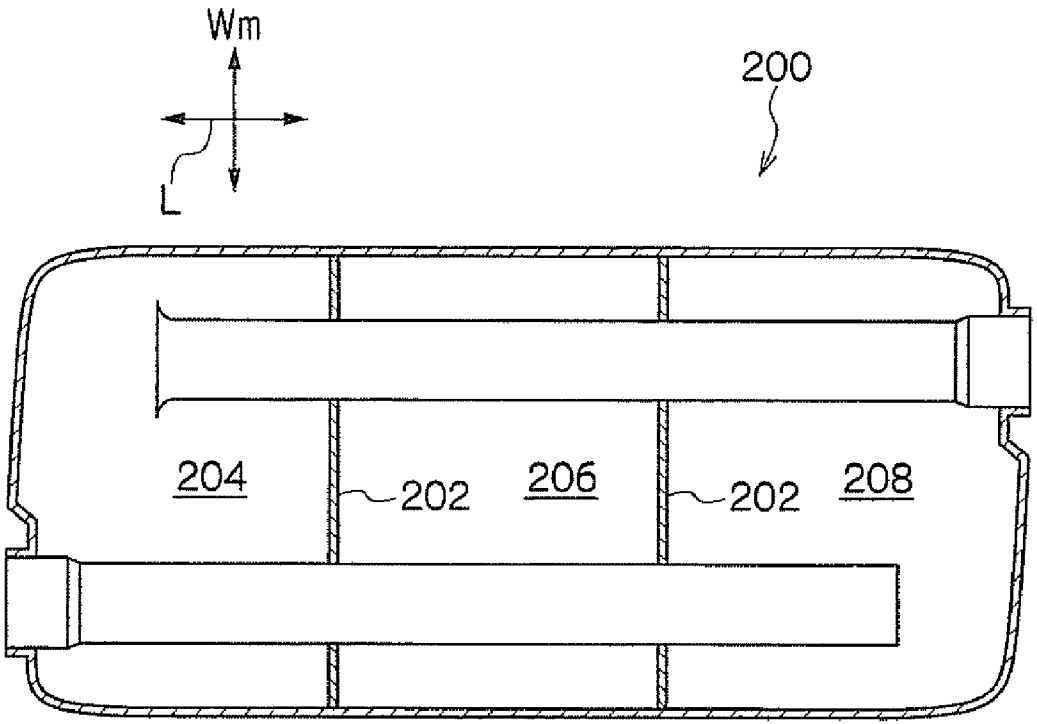
FIG. 20B is a side cross sectional view showing the muffler for the vehicle in accordance with the comparative example with the exemplary embodiments of the present invention.
Figure 20A:
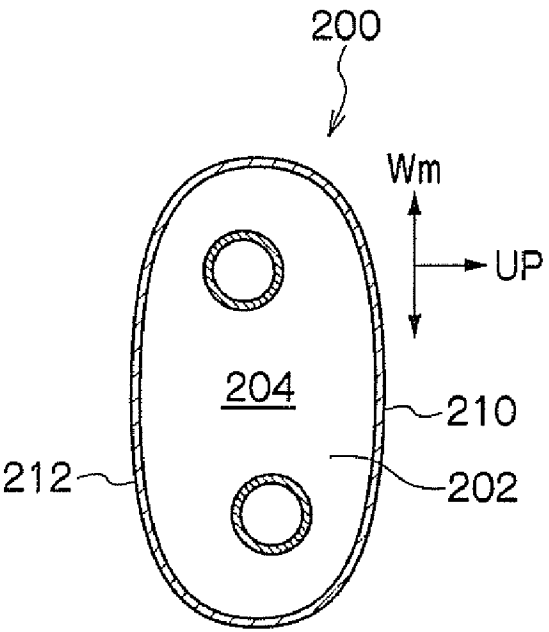
FIG. 20A is a front elevational cross sectional view showing a muffler for a vehicle in accordance with a comparative example with the exemplary embodiments of the present invention.

A description will be given of the emission sound suppressing effect on the basis of a comparison with a comparative example muffler 200 shown in FIGS. 20A and 20B. The comparative example muffler 200 is constituted by a wound muffler which is formed flat in the vertical direction, and three expansion chambers 204, 206 and 208 are formed by two isolation walls 202 partitioning an inner portion in the longitudinal direction. In the comparative example muffler 200 as mentioned above, since a rigidity of upper and lower flat surfaces 210 and 211 which are wider in the muffler width direction is low, the emission sound tends to be generated if the exhaust gas flow comes into contact with the flat surfaces 210 and 212.

Further, in the vehicle muffler 10, since the muffler shell 16 is structured by joining the upper shell 18 and the lower shell 20 each of which corresponds to the press worked product, the suppression of the emission sound may be achieved while providing the simple structure, and being flat and light. Further, since the upper shell 18 and the lower shell 20 both have the first outer walls 18A and 20A and the second outer walls 18B and 20B, the draw depth by the press working of the first outer walls 18A and 20A and the second outer walls 18B and 20B may be made shallow, and a formability is good. Further, since the peripheral joint flanges 18C and 20C and the inter-isolation chamber joint flanges 18D and 20D are formed as the same flat surface in the upper shell 18 and the lower shell 20, the joint of the peripheral joint 16A and the joint of the inter-isolation chamber joint 16B may be set to the same operation.

Further, in the vehicle muffler 10, since the communication path 26 communicating the isolation chamber 12 with the isolation chamber 14 is provided in the muffler shell 16, there is achieved the structure in which the isolation chamber 12 and the isolation chamber 14 are used as the independent expansion chambers which are continuous in the gas flow direction. Accordingly, the noise reduction performance of the vehicle muffler 10 may be secured. Further, since the communication path 26 is provided at the inter-isolation chamber joint 16B, that is, the joint between the inter-isolation chamber joint flange 18D and the inter-isolation chamber joint flange 20D, in other words, since the communication path 26 is arranged in a trough portion between the first outer wall 18A and the second outer wall 18B, the communicating portion may be provided on the basis of the simple structure without increasing the height H of the muffler shell 16 (the thickness of a whole of the muffler).

Further, in the vehicle muffler 10, since the inner pipe 30 is provided within the isolation chamber 14, the space within the isolation chamber 14 may be divided into the third expansion chamber 14A corresponding to the outer side of the inner pipe 30, and the exhaust path in the inner side of the inner pipe 30. Accordingly, in this exemplary embodiment, there is achieved the structure in which the flow path (a stroke length) necessary for reducing noise of the exhaust gas is secured in a limited space within the outer shell of the muffler shell 16, by making the gas flow direction in the inner pipe 30 opposite from the gas flow direction in the third expansion chamber 14A. Further, since the inner pipe 30 is retained to the isolation chamber 14 through the separator 32, the rigidity of the second outer walls 18B and 20B is further improved, and the rigidity for supporting the inner pipe 30 is secured.

Further, in the vehicle muffler 10, since the first outer wall 18A constructing the isolation chamber 12 and the second outer wall 18B constructing the isolation chamber 14 are bridged in the muffler width direction by the base portion 46 of the muffler support 42, the rigidity is improved in a direction in which the isolation chamber 12 of the muffler shell 16 moves towards and away from the isolation chamber 14, and the relative displacement in the parallel direction of the isolation chambers 12 and 14 (the bending deformation of the inter-isolation chamber joint 16B) is suppressed. Further, since the rod portion 48 is provided at the base portion 46, the muffler vibration caused by the support to the vehicle body by the muffler support 42 may be suppressed.

Particularly, since the base portion 46 is joined to the inter-isolation chamber joint 16B, that is, the overlapping portion between the inter-isolation chamber joint flange 18D and the inter-isolation chamber joint flange 20D, in other words, since the bridging member is joined in the portion including three points having the outer walls 18A and 18B of the isolation chambers 12 and 14 and the inter-isolation chamber joint 16B, the rigidity of each of the portions of the muffler shell 16 is further improved, and the muffler vibration caused by the support to the vehicle body by the muffler support 42 attached to the high rigidity portion may be more effectively suppressed.

Next, a description will be given of the other exemplary embodiment in accordance with the invention. It should be noted that components and parts which are fundamentally the same as those of the above first exemplary embodiment, or previous configurations, are allocated the same reference numerals as those of the above first exemplary embodiment, or previous configurations, and explanation thereof is sometimes omitted.

Second Exemplary Embodiment

Figure 5:
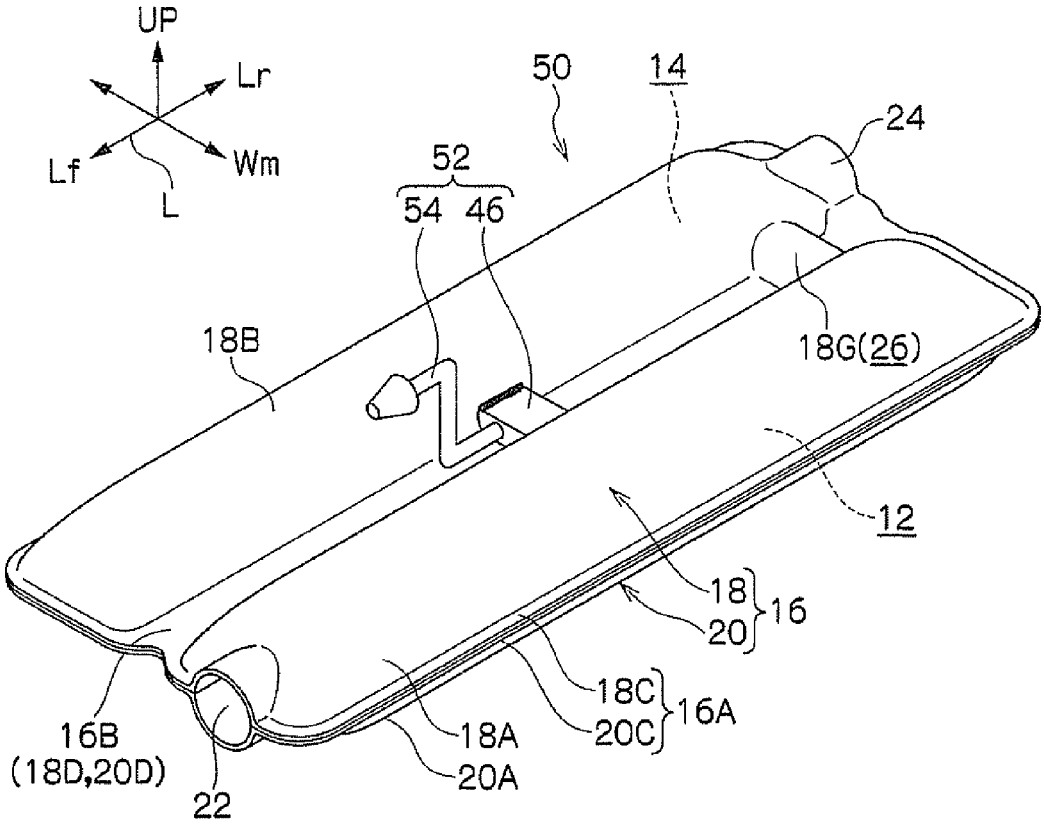
FIG. 5 is a perspective view of a muffler for a vehicle according to a second exemplary embodiment of the present invention.

FIG. 5 shows a vehicle muffler 50 in accordance with a second exemplary embodiment of the invention by a perspective view. As shown in this drawing, the vehicle muffler 50 is different from the vehicle muffler 10 in accordance with the first exemplary embodiment in a point that the vehicle muffler 50 is supported to the vehicle body by a muffler support 52 in place of the muffler support 42.

The muffler support 52 has the base portion 46, and the base portion 46 is fixed to (near) a position coming to a center of gravity point of the vehicle muffler 50 in a plan view in the muffler shell 16. The fixing structure is the same as the fixing structure of the base portion 46 in the vehicle muffler 10. A rod portion 54 supported to the vehicle body through the support rubber 44 is extended from the base portion 46. The other structures of the vehicle muffler 50 is the same as the corresponding structure of the vehicle muffler 10.

Accordingly, on the basis of the vehicle muffler 50 in accordance with the second exemplary embodiment, the same effects may be obtained by the same operation as the vehicle muffler 10 in accordance with the first exemplary embodiment. Further in the vehicle muffler 50, since the vehicle muffler 50 is suspended to the vehicle body through the muffler support 52 at the center of gravity position, the muffler mass (the load) of the vehicle muffler 50 is approximately uniformly applied to the muffler support 52, and a deviation of the applied load to the muffler support 52 may be suppressed. Accordingly, the motion of the vehicle muffler 50 with respect to the vehicle body may be efficiently suppressed, and the muffler vibration caused by the support to the vehicle body by the muffler support 52 may be further effectively suppressed.

In this case, the vehicle muffler 50 constructed by joining the upper shell 18 and the lower shell 20 corresponding to the press worked product of the metal thin plate as mentioned above is light, the vehicle muffler 50 may be supported at one point by the muffler support 52.

In this case, in the second exemplary embodiment, there is shown the example in which the portion near the center of gravity point is supported at one point by the muffler support 52, however, the invention is not limited to this. For example, the gravity point of the vehicle muffler 50 may be supported at three points by the muffler support 42 or the muffler support 52 and the muffler supports respectively provided at both corner portions in the rear end side of the peripheral joint 16A.

Third Exemplary Embodiment

Figure 6:
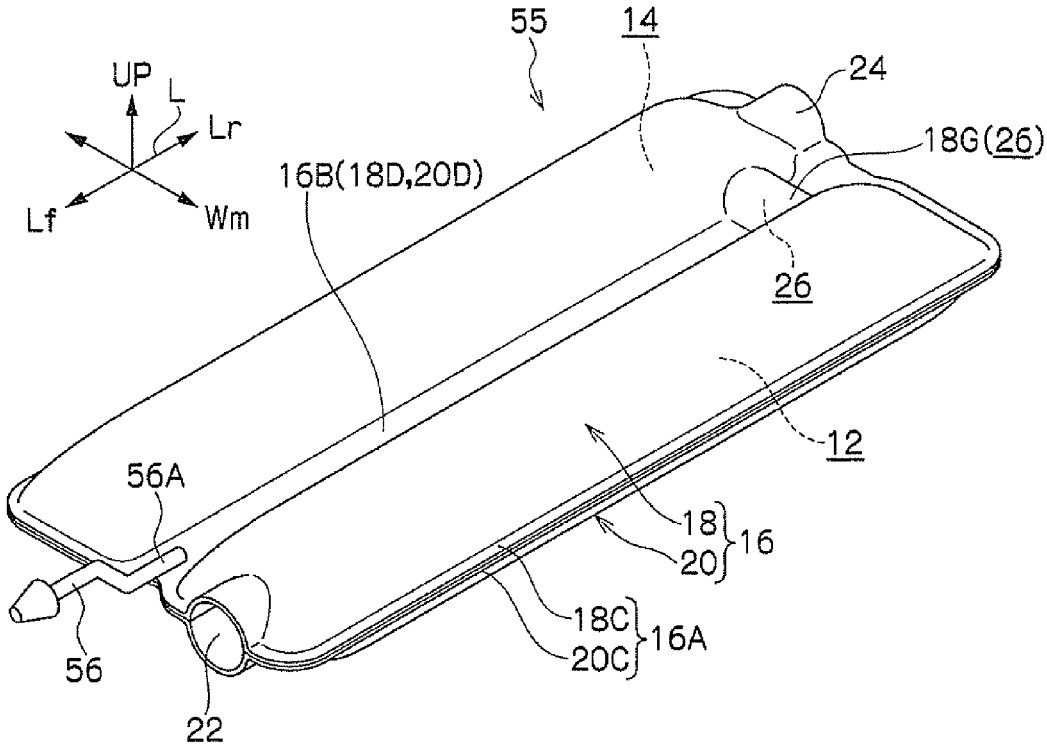
FIG. 6 is a perspective view of a muffler for a vehicle according to a third exemplary embodiment of the present invention.

FIG. 6 shows a vehicle muffler 55 in accordance with a third exemplary embodiment of the invention by a perspective view. As shown in this drawing, the vehicle muffler 55 is different from the vehicle muffler 10 in accordance with the first exemplary embodiment in a point that the vehicle muffler 55 is supported to the vehicle body by a muffler support 56 in place of the muffler support 42.

The muffler support 56 is not provided with the base portion 46 bridging the first outer wall 18A and the second outer wall 18B, and a rear end 56A thereof is joined only to the inter-isolation chamber joint 16B (the inter-isolation chamber joint flange 18D). Since the inter-isolation chamber joint 16B formed as the mating flat plate shape is different from (the first outer walls 18A and 20A and the second outer walls 18B and 20B constructing) the isolation chamber 12 and the isolation chamber 14 in an vibration characteristic, that is, a resonance point, a double vibration isolating structure is employed together with the vibration isolation by the support rubber 44, by attaching the muffler support 56 to the inter-isolation chamber joint 16B. Accordingly, an vibration cutoff performance of the vehicle muffler 10 is improved.

Further, since the thickness of the inter-isolation chamber joint 16B is twice the thickness of the upper shell 18 simple substance, the support rigidity to the vehicle body of the vehicle muffler 10 may be secured. In other words, the muffler vibration caused by the support to the vehicle body by the muffler support 56 may be further more effectively suppressed.

In this case, needless to say, the muffler support 56 having no bridging member may be provided at a gravity position Ge of the vehicle muffler 55.

Fourth Exemplary Embodiment

Figure 7:
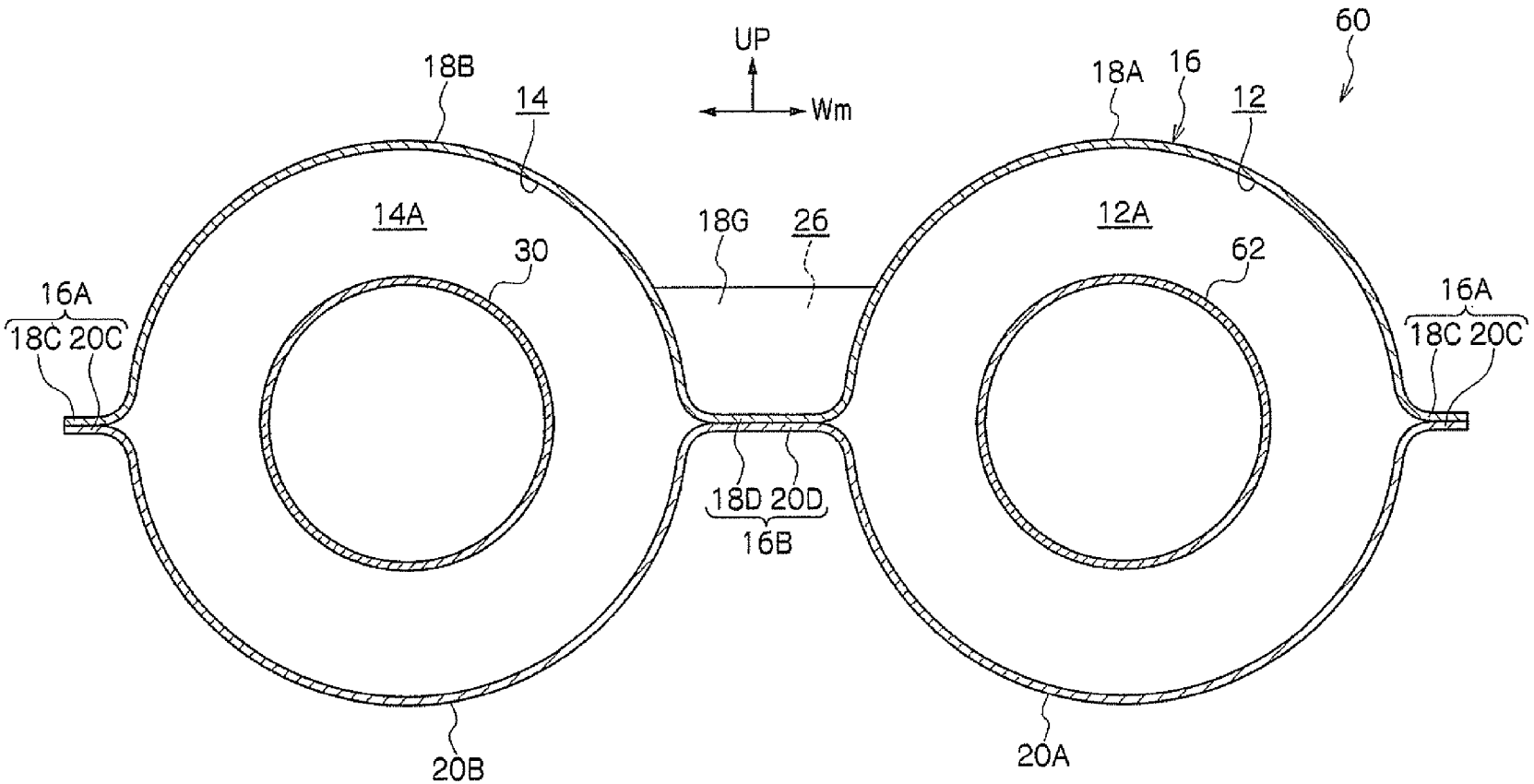
FIG. 7 is a cross sectional view corresponding to FIG. 2 and showing a muffler for a vehicle according to a fourth exemplary embodiment of the present invention.

FIG. 7 shows a vehicle muffler 60 in accordance with a fourth exemplary embodiment of the invention by a cross sectional view corresponding to FIG. 2. As shown in this drawing, the vehicle muffler 60 is different from the vehicle muffler 10 in accordance with the first exemplary embodiment in a point that the vehicle muffler 60 is provided with an inner pipe 62 introduced to the isolation chamber 12.

The inner pipe 62 is formed as an inlet pipe which is fitted to the gas introduction port 22 so as to be introduced to the first expansion chamber 12A, in this exemplary embodiment. The other structures of the vehicle muffler 60 are the same as the corresponding structure of the vehicle muffler 10.

Accordingly, on the basis of the vehicle muffler 60 in accordance with the fourth exemplary embodiment, the same effects may be obtained by the same operation as the vehicle muffler 10 in accordance with the first exemplary embodiment. Further, since the inner pipe 62 is introduced to the first expansion chamber 12A, the effect of damping the sound energy is improved.

Fifth Exemplary Embodiment

Figure 8:
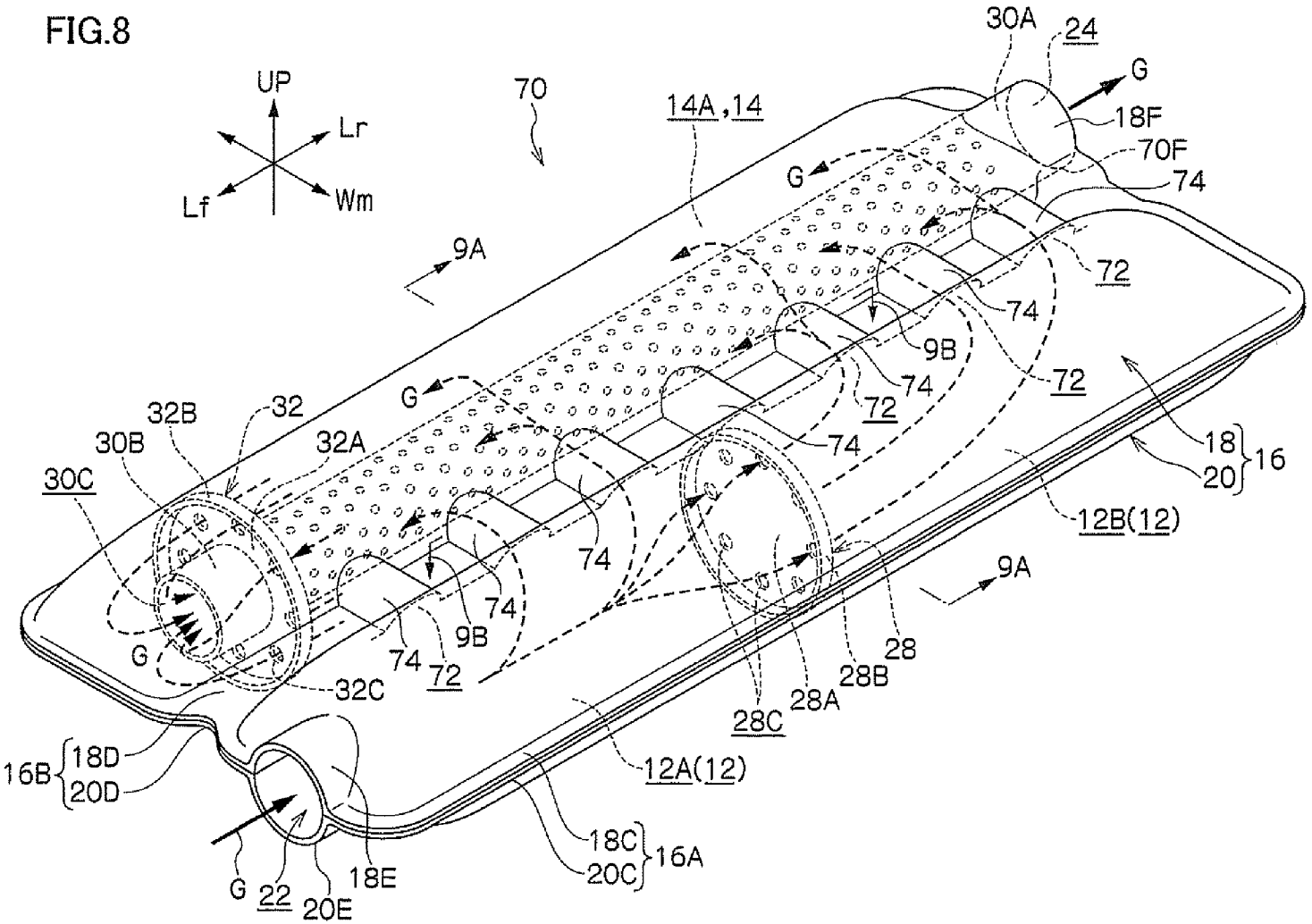
FIG. 8 is a perspective view of a muffler for a vehicle according to a fifth exemplary embodiment of the present invention.

FIG. 8 shows a vehicle muffler 70 in accordance with a fifth exemplary embodiment of the invention by a perspective view. As shown in this drawing, the vehicle muffler 70 is different from the vehicle muffler 10 in accordance with the first exemplary embodiment in a point that the vehicle muffler 70 has a plurality of communication paths 72 as the communicating portion in place of the communication path 26.

Figure 9A:
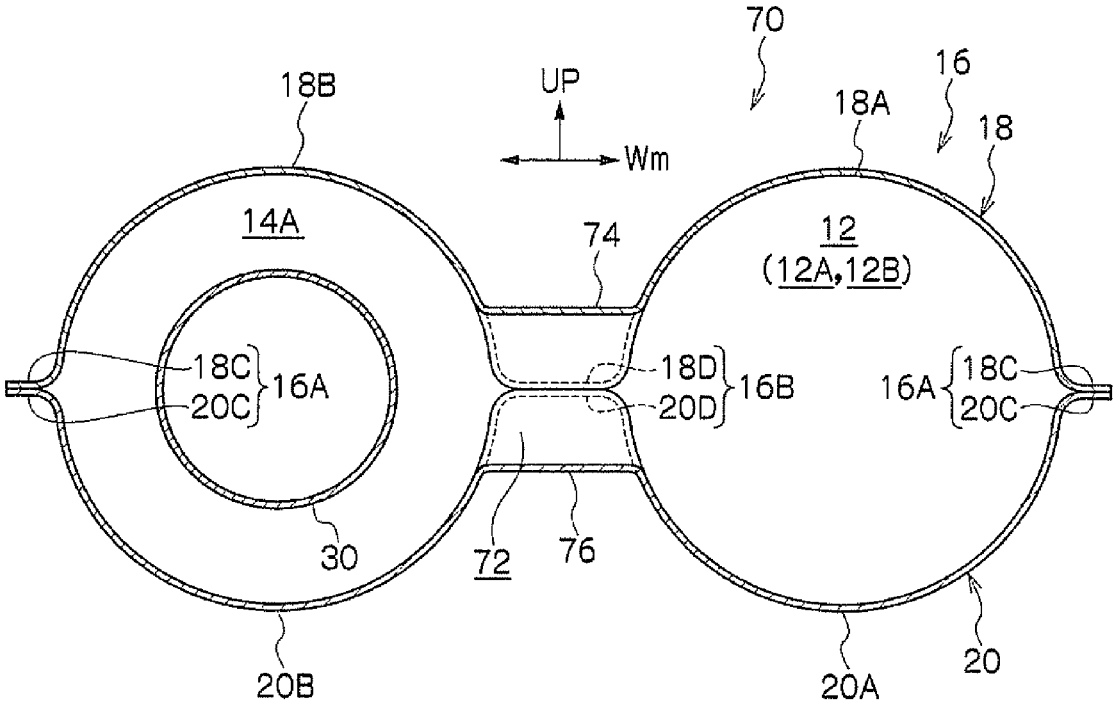
FIG. 9A is a cross sectional view along a line 9A-9A in FIG. 8.
Figure 9B:
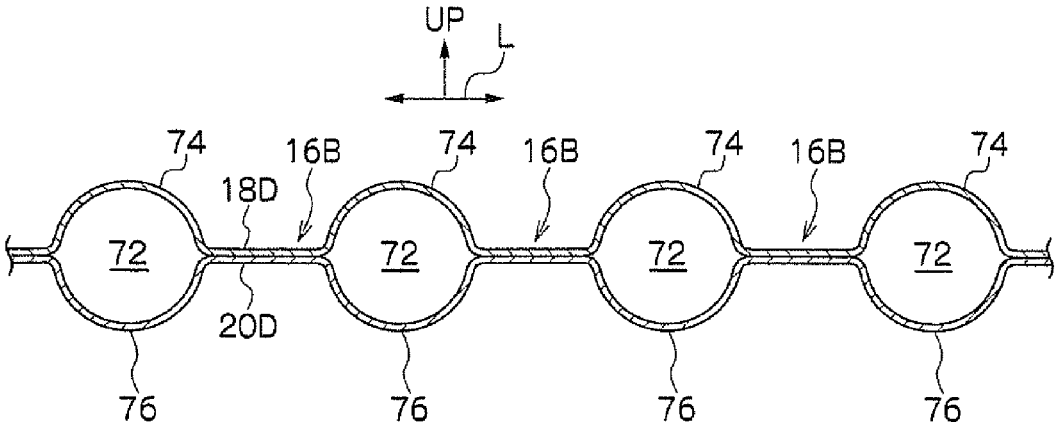

A plurality of communication paths 72 are arranged in the inter-isolation chamber joint 16B of the muffler shell 16 so as to be away from each other in the muffler front-rear direction, and a flow path cross sectional area of each of them is made smaller than a flow path cross sectional area of the communication path 26. As shown in FIGS. 9A and 9B, each of the communication paths 72 is structured by confronting open ends of a tunnel portion 74 formed at the inter-isolation chamber joint flange 18D and a tunnel portion 76 formed at the inter-isolation chamber joint flange 20D, and the inter-isolation chamber joint flanges 18D and 20D are joined in front and rear sides of the tunnel portion 74 and the tunnel portion 76, whereby the communication path 72 is structured. Accordingly, in this exemplary embodiment, the upper shell 18 and the lower shell 20 may be formed by the same dies work.

Further, in a plurality of communication paths 72, a dimension, a number, a layout and the like thereof are set in such a manner as to absorb (damp) the sound energy of the passing exhaust gas. In other words, a plurality of communication paths 72 are structured such as to achieve a reducing function or a tuning function of the exhaust sound mainly constituted by the pulsation sound (serve as a tuning element) by damping the sound energy of the passing exhaust gas, in addition to being simply communicated with the isolation chamber 12 and the isolation chamber 14. In other words, in the vehicle muffler 70, a plurality of communication paths 72 are added as the tuning element for reducing the exhaust sound to the vehicle muffler 10, in addition to the through hole 28C of the separator 28 or the like. The other structures of the vehicle muffler 70 are the same as the corresponding structures of the vehicle muffler 10.

Accordingly, on the basis of the vehicle muffler 70 in accordance with the fifth a exemplary embodiment, the same effect (the emission sound reducing effect, the vibration prevention by the muffler support 42 and the like) may be obtained by the same operation as the vehicle muffler 10 in accordance with the first exemplary embodiment. Further, since the vehicle muffler 70 is provided with a plurality of communication paths 72 having the smaller flow path cross sectional area than that of the communication path 26, the reducing operation (the noise reduction effect) of the pulsation sound may be obtained on the basis of the damping effect of the sound energy. Particularly, the tuning range for reducing the pulsation sound is wide on the basis of the magnitude, the number, the layout and the like of a plurality of communication paths 72 and the effective exhaust sound reduction may be achieved, and an after working (a drilling or the like) for tuning is not necessary. Further, since the flow path area of a plurality of communication paths 72 is small, a generation of a flow noise caused by the gas pass is suppressed.

Further, in the vehicle muffler 70, since a plurality of communication paths 72, that is, the closed cross section structures are formed along the muffler front-rear direction in the inter-isolation chamber joint 16B, the rigidity between the isolation chambers 12 and 14 is significantly improved in comparison with the structure in which the inter-isolation chamber joint 16B is formed as the simple mating flat plate shape. Accordingly, the vibration and noise performance is significantly improved in spite of the flat muffler.

Figure 10A:
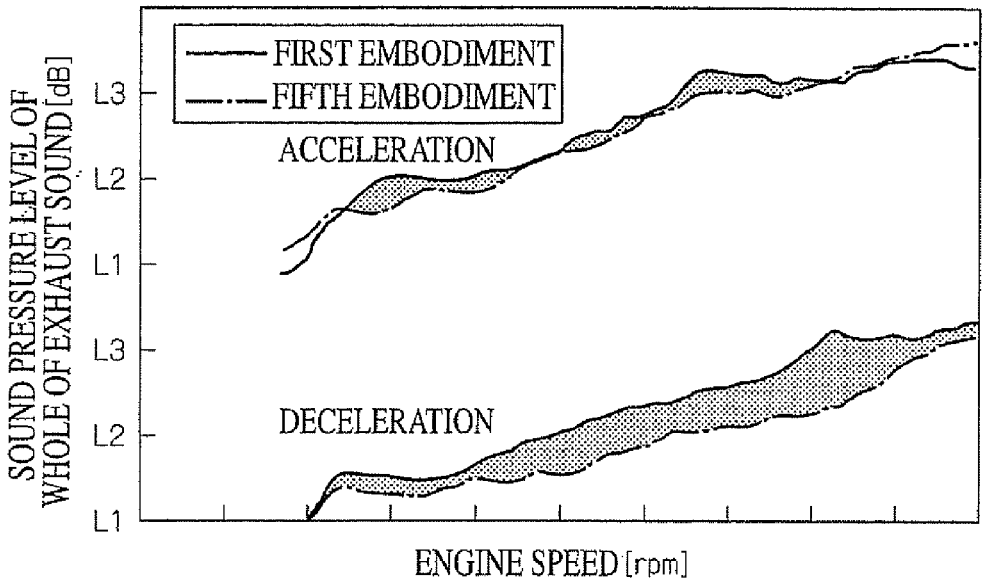
FIG. 10A is a view comparing an exhaust sound reducing effect of a muffler for a vehicle in accordance with the fifth exemplary embodiment of the present invention with the first exemplary embodiment of the present invention, and a graph comparing a whole of the exhaust sound.
Figure 10B:
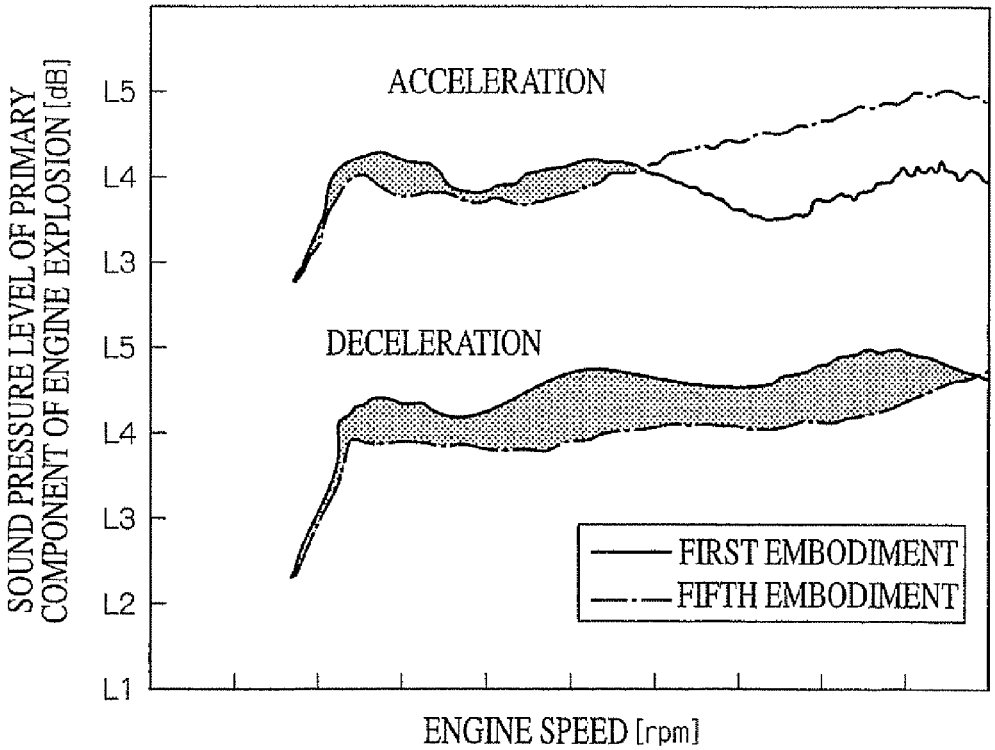
FIG. 10B is a view comparing the exhaust sound reducing effect of the muffler for the vehicle in accordance with the fifth exemplary embodiment of the present invention with the first exemplary embodiment of the present invention, and a graph comparing a primary component of an engine explosion.

As mentioned above, in accordance with the vehicle muffler 70, the reducing effect of the exhaust sound (a whole of the exhaust sound including the emission sound, the pulsation sound, and the flow sound) is high in comparison with the vehicle muffler 10. Specifically, as shown in FIG. 10A, it is known that the exhaust sound is reduced as a whole than the vehicle muffler 10 both when the vehicle accelerates and the vehicle decelerates. Particularly, as shown in FIG. 10B, with regard to a sound pressure of a primary component of the engine explosion, it is known that the reducing effect at a time of a low rotation speed (particularly, when the vehicle accelerates) is great by setting a plurality of communication paths 72 in place of the single communication path 26. In other words, in the vehicle muffler 70, a reduction of the whole exhaust sound reduction is achieved in comparison with the vehicle muffler 10, by setting a plurality of communication paths 72 to the tuning element for reducing the exhaust sound (adding the tuning element). Further, since a plurality of communication paths 72 is formed by simply joining the inter-isolation chamber joint flange 18D and the inter-isolation chamber joint flange 20D, it is not necessary to carry out the after working such as the drilling or the like for obtaining the reducing effect of the exhaust sound mentioned above.

Sixth Exemplary Embodiment

Figure 11A:
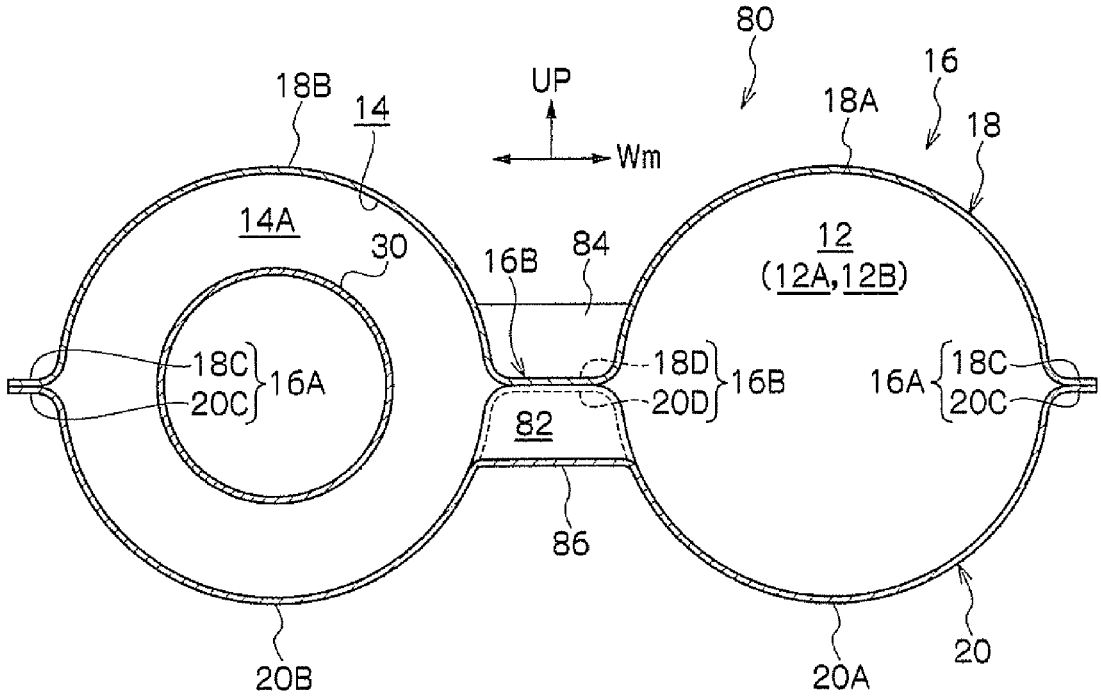
FIG. 11A is a cross sectional view corresponding to FIG. 9A and shows a muffler for a vehicle according to a sixth exemplary embodiment of the present invention.
Figure 11B:
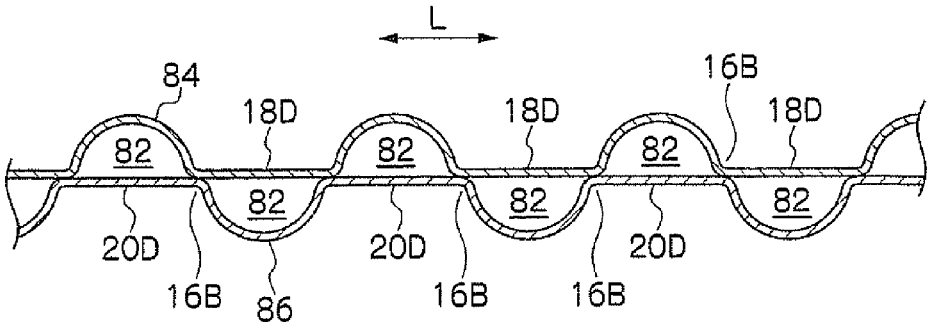
FIG. 11B is a cross sectional view corresponding to FIG. 9B and shows the muffler for the vehicle according to the sixth exemplary embodiment of the present invention.

A vehicle muffler 80 in accordance with a sixth exemplary embodiment of the invention is shown in FIGS. 11A and 11B by cross sectional views corresponding to FIGS. 9A and 9B. As sown in these drawings, the vehicle muffler 80 is in common with the vehicle muffler 70 in accordance with the fifth exemplary embodiment in a point that a plurality of communication paths 82 are provided, and is different from the vehicle muffler 70 in a structure of a plurality of communication paths 82.

A plurality of communication paths 82 are structured by offsetting open ends of a tunnel portion 84 formed at the inter-isolation chamber joint flange 1 SD and a tunnel portion 86 formed at the inter-isolation chamber joint flange 20D over a whole length (in such a manner that the open ends are alternately arranged), and closing the respective open ends with the flat plate portion of the opposing inter-isolation chamber joint flange. The joint positions of the inter-isolation chamber joint flanges 18D and 20D correspond to open edge portions of the tunnel portions 84 and 86 which are adjacent back and forth.

Further, a dimension, a number, a layout and the like of each of a plurality of communication paths 82 are set in such a manner as to absorb (damp) the sound energy of the passing exhaust gas. In other words, a plurality of communication paths 82 are structured such as to achieve the reducing function or the tuning function of the exhaust sound, in addition to simply communicating the isolation chamber 12 with the isolation chamber 14. The other structures of the vehicle muffler 80 are the same as the corresponding structures of the vehicle muffler 10.

Accordingly, on the basis of the vehicle muffler 80 in accordance with the sixth exemplary embodiment, the same effect may be obtained by the same operation as that of the vehicle muffler 10 in accordance with the first exemplary embodiment, and the same effect (the exhaust sound reduction, the turning, and the rigidity improvement between the isolation chambers 12 and 14) may be obtained by the same operation as that of the vehicle muffler 70 in accordance with the fifth exemplary embodiment. Particularly, in the vehicle muffler 80, a cross sectional area of each of a plurality of communication paths 82 tends to be set smaller than a Cross sectional area of the communication path 72, and a fine exhaust sound reduction and tuning may be carried out.

Seventh Exemplary Embodiment

Figure 12:
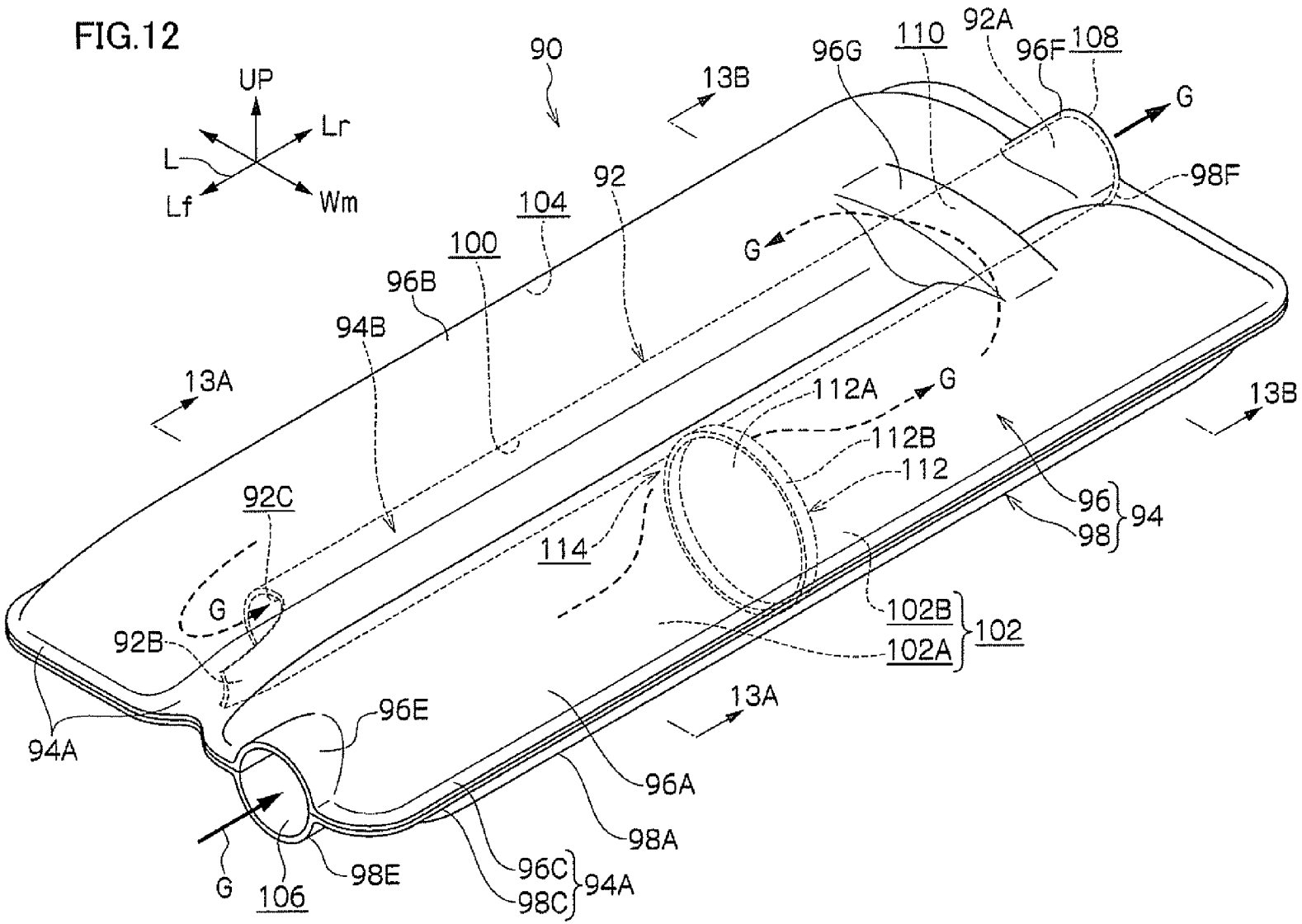
FIG. 12 is a perspective view of a muffler for a vehicle according to a seventh exemplary embodiment of the present invention.
Figure 13A:
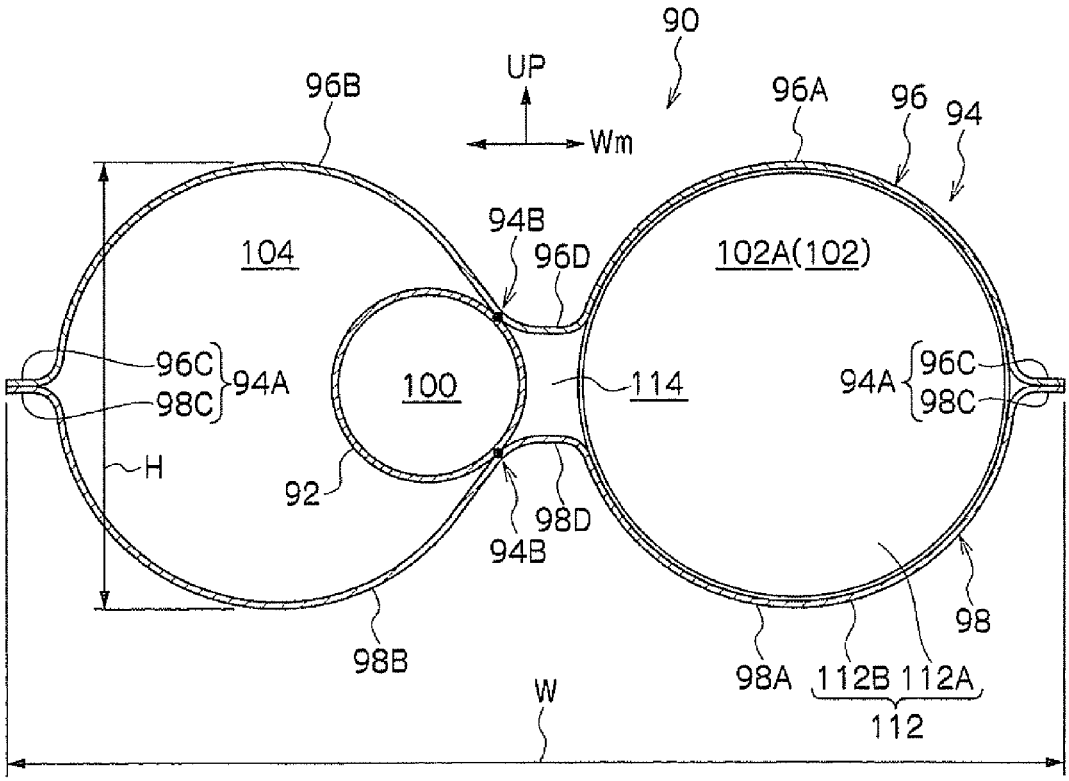
FIG. 13A is a cross sectional view along a line 13A-13A in FIG. 12.
Figure 13B:
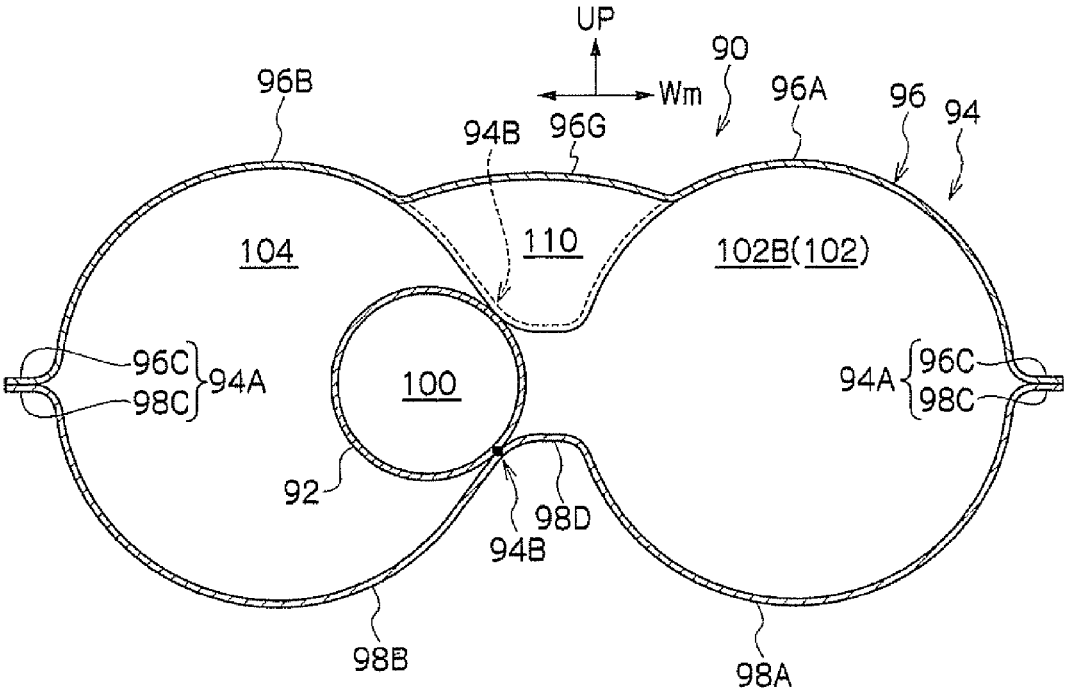
FIG. 13B is a cross sectional view along a line 13B-13B in FIG. 12.

FIG. 12 shows a vehicle muffler 90 in accordance with a seventh exemplary embodiment of the invention by a perspective view. Further, a cross sectional view alone a line 13A-13A in FIG. 12 is shown in FIG. 13A, and a cross sectional view along a line 13B-13B in FIG. 12 is shown in FIG. 13B, respectively. As shown in these drawings, the vehicle muffler 90 is different from the vehicle muffler 10 in accordance with the first exemplary embodiment in that the vehicle muffler 90 is provided with a muffler shell 94 in which a joint portion to an inner pipe 92 serving as a built-in pipe member is formed as an inter-isolation chamber joint 94B, in place of the muffler shell 16 in which the inter-isolation chamber joint flange 18D of the upper shell 18 and the inter-isolation chamber joint flange 20D of the lower shell 20 are directly joined so as to structure the inter-isolation chamber joint 16B. A description will be specifically given below.

The muffler shell 94 is structured by joining an upper shell 96 and a lower shell 98. As shown in FIGS. 13A and 13B, the upper shell 96 is structured such as to have a first outer wall 96A and a second outer wall 96B which are formed as an approximately semi-cylindrical shape being open to a downward side in a cross sectional view which is orthogonal to the longitudinal direction and are arranged in parallel in the muffler width direction, a peripheral joint flange 96C formed at such a manner as to surround a periphery of the first outer wall 96A and the second outer wall 96B, and a coupling wall portion 96D coupling open edges in an inner side in the muffler width direction of the first outer wall 96A and the second outer wall 96B. The coupling wall portion 96D is positioned in an upper side than the peripheral joint flange 96C, and a depth of a space within the first outer wall 96A and 96B with respect to an open plane extending between the coupling wall portion 96D and the peripheral joint flange 96C is shallower than the corresponding depth in the upper shell 18.

The lower shell 98 is structured such as to have a first outer wall 98A and a second outer wall 98B which are formed as an approximately semi-cylindrical shape being open to an upward side in a cross sectional view which is orthogonal to the longitudinal direction and are arranged in parallel in the muffler width direction, a peripheral joint flange 98C formed in such a manner as to surround a periphery of the first outer wall 98A and the second outer wall 98B, and a coupling wall portion 98D coupling open edges in an inner side in the muffler width direction of the first outer wall 98A and the second outer wall 98B. The coupling wall portion 98 is positioned in a lower side than the peripheral joint flange 98C, and a depth of a space within the first outer wall 98A and 98B with respect to an open plane extending between the coupling wall portion 98D and the peripheral joint flange 98C is shallower than the corresponding depth in the lower shell 20.

The muffler shell 94 is structured such that a peripheral joint 94A is formed by joining the peripheral joint flange 96C of the upper shell 96 and the peripheral joint flange 98C of the lower shell 98, and the coupling wall portion 96D and the coupling wall portion 98D are away from each other in the vertical direction in a center section in the muffler width direction. In this muffler shell 94, a space formed at an inner side of the peripheral joint 94A is partitioned into isolation chambers 100, 102 and 104 which are formed long in the muffler front-rear direction and are arranged in parallel in the muffler width direction, by the inner pipe 92 arranged in the muffler front-rear direction. In this case, the isolation chamber 100 corresponds to an internal space of the inner pipe 92, and the isolation chambers 102 and 104 are positioned in both sides in the muffler width direction with respect to the isolation chamber 100.

Further, as shown in FIGS. 13A and 13B, the inner pipe 92 is arranged so as to be offset to the isolation chamber 104 side from the center section in the muffler width direction, in the muffler shell 94. Specifically, the inner pipe 92 is joined to a portion near the coupling wall portion 96D of the second outer wall 96B in the upper shell 96, and a portion near the coupling wall portion 98D of the second outer wall 98B in the lower shell 98 by laser welding or the like, whereby the inter-isolation chamber joint 94B is structured. The inter-isolation chamber joint 94B is structured such that the upper shell 96, the lower shell 98 and the inner pipe 92 are continuously or intermittently joined along the muffler front-rear direction.

Further, as shown in FIG. 12, a gas introduction port 106 to which the exhaust gas is introduced, and a gas discharge port 108 discharging the exhaust gas are formed at the muffler shell 94. The gas introduction port 106 is open to a forward side in the muffler front-rear direction, and communicates a front end of the isolation chamber 102 and an outside of the muffler shell 94. The gas discharge port 108 is open to a backward side in the muffler front-rear direction, and communicates a rear end of the isolation chamber 100 and the outside of the muffler shell 94. Although an illustration is omitted, a rear end of an inlet pipe is connected to the gas introduction port 106, and a front end of the outlet pipe 38 is connected to the gas discharge port 108.

The gas introduction port 106 is formed by making non-joined portions between a gas introduction port forming portion 96E of the peripheral joint flange 96C and a gas introduction port forming portion 98E of the peripheral joint flange 98C, the gas introduction port forming portion 96E being a portion positioned at a front side of the first outer wall 96A in the peripheral joint flange 96C of the upper shell 96 and formed as a semi-cylindrical shape which is open downward along a longitudinal direction, and the gas introduction port forming portion 98E being a portion positioned at a front side of the first outer wall 98A in the peripheral joint flange 98C of the lower shell 98 and formed as a semi-cylindrical shape which is open upward along the longitudinal direction.

In the same manner, the gas discharge port 108 is formed by making non-joined portions between a gas introduction port forming portion 96F of the peripheral joint flange 96C and a gas introduction port forming portion 98F of the peripheral joint flange 98C, the gas introduction port forming portion 96F being a portion positioned at a front side of the first outer wall 96A in the peripheral joint flange 96C of the upper shell 96 and formed as a semi-cylindrical shape which is open downward along a longitudinal direction, and the gas introduction port forming portion 98F being a portion positioned at a front side of the first outer wall 98A in the peripheral joint flange 98C of the lower shell 98 and formed as a semi-cylindrical shape which is open upward along the longitudinal direction.

Figure 14:
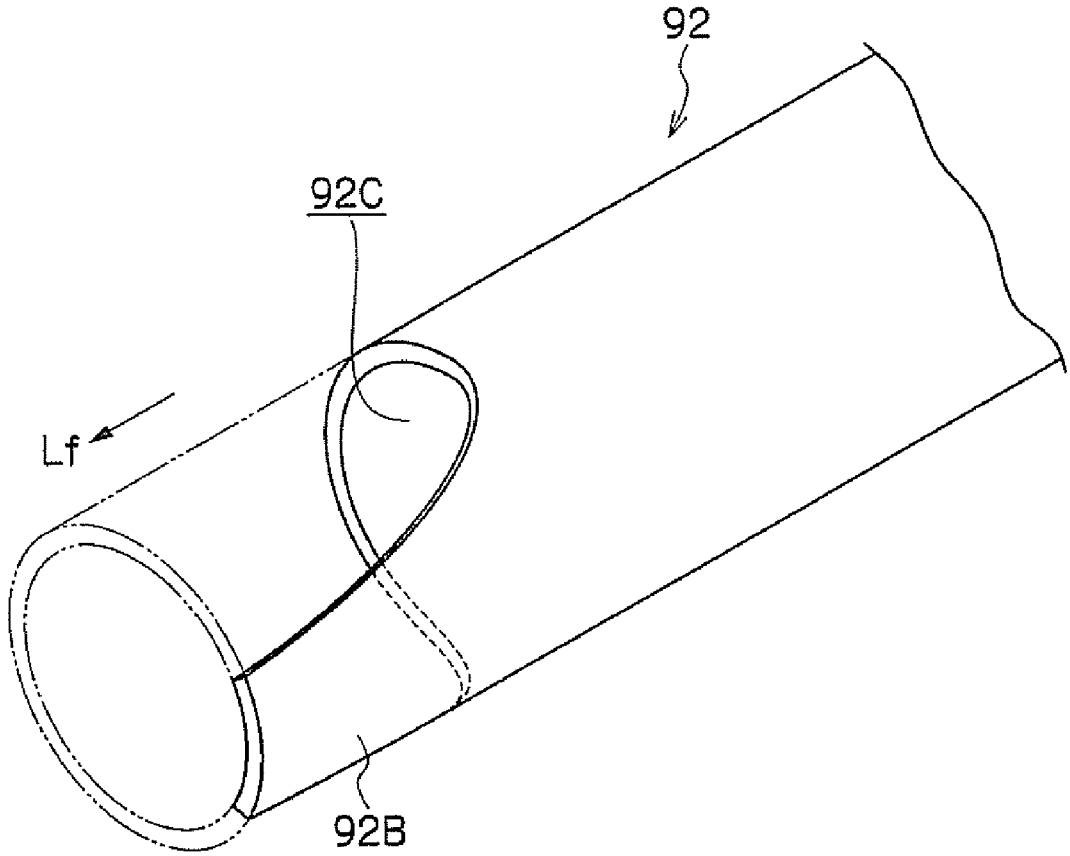
FIG. 14 is a perspective view showing an end portion shape of an inner pipe constructing the muffler for the vehicle according to the seventh exemplary embodiment of the present invention.

On the other hand, in a front end of the inner pipe 92, there is formed a partition piece 92B which is positioned at a portion narrowed vertically to a smaller dimension than an outer diameter of the inner pipe 92 within the muffler shell 94 and partitions the isolation chamber 102 and the isolation chamber 104. As shown in FIG. 14, the partition piece 92B is structured as a portion that remains after cutting when a portion shown by two-dot chain lines is cut from an end portion of the pipe (the inner pipe 92) before being worked. Since the partition piece 92B is formed at the isolation chamber 102 side in the inner pipe 92, the front side opening portion 92C of the inner pipe 92 is open to the isolation chamber 104 side.

Further, a communication path 110 serving as a communicating portion communicating a pair of isolation chambers 102 and 104 is formed at the muffler shell 94. As shown in FIGS. 12 and 13B, the communication path 110 is structured as an inner space of a tunnel portion 96G bridging over the first outer wall 96A and the second outer wall 96B in the upper shell 96, and communicates between rear portions of the isolation chamber 102 and the isolation chamber 104 while striding over the inner pipe 92 (the isolation chamber 100). In this case, a tunnel portion which is approximately symmetrical with the tunnel portion 96G may be provided at the lower shell 98 side.

Each of the upper shell 96 and the lower shell 98 described above is integrally formed in respective portions by a press working of a metal thin plate. Further, the upper shell 96 and the lower shell 98 may be structured by making the portions along the longitudinal direction in the peripheral joint flange 96C and the peripheral joint flange 98C common (integral) and folding back the common portions. In this case, the upper shell 96 and the lower shell 98 may be integrally (simultaneously) formed. It should be noted that the upper shell 96 corresponds to the upper shell or the cover body in the present invention, and the lower shell 98 corresponds to the lower shell or the cover body in the present invention.

Further, a separator 112 partitioning the isolation chamber 102 back and forth is arranged within the isolation chamber 102 of the muffler shell 94. The separator 112 is structured such as to have a flat plate shaped partition plate portion 112A partitioning the isolation chamber 102 back and forth, and a ring-shaped fitting portion 112B provided at the partition plate portion 112A so as to be extended from a peripheral edge. The fitting portion 112B fitted to an inner periphery (the first outer walls 96A and 98A) of the isolation chamber 102 is fixed to the inner periphery of the isolation chamber 102 by a welding or the like, whereby the separator 112 is retained with respect to the muffler shell 94.

A first expansion chamber 102A corresponding to a space in a front side of the separator 112 in the isolation chamber 102 is communicated with a second expansion chamber 102B corresponding to a space in a rear side of the separator 112 in the isolation chamber 102 through a contraction flow path 114 formed between the separator 112 and the inner pipe 92 shown in FIG. 13A. The contraction flow path 114 (the coupling wall portions 96D and 98D) is structured such that generates a contraction flow and an expansion in the passing gas flow, and the noise reduction effect is obtained.

In the vehicle muffler 90 described above a configuration is provided such that the exhaust gas introduced to the isolation chamber 102 from the gas introduction port 106 reaches the second expansion chamber 102B by passing through the contraction flow path 114 from the first expansion chamber 102A, and is introduced to the isolation chamber 104 serving as the third expansion chamber by further passing through the communication path 110, as shown by an arrow G in FIG. 12. Further, the exhaust gas introduced to the isolation chamber 104 is structured such as to be introduced to the inner pipe 92 from the front side opening portion 92C of the inner pipe 92, and be discharged to the outlet pipe 38 from the gas discharge port 108 (the rear end portion 92A) while passing through the inner pipe 92. It should be noted that a gas hole 30D may be wholly or partly provided at the inner pipe 92 so as to obtain an absorbing effect of the sound energy.

The vehicle muffler 90 described above is structured such that the first outer wall 96A constructing the isolation chamber 102 and the second outer wall 96B constructing the isolation chamber 104 are supported to the vehicle body by the same structure as that of any one of the first to third exemplary embodiments although an illustration is omitted.

Explanation will now be given of the operation of the seventh exemplary embodiment.

In the vehicle muffler 90 having the structure mentioned above, the exhaust gas introduced from the inlet pipe 34 (the gas introduction port 106) is expanded by the first expansion chamber 102A, generates the contraction flow at the time of passing through the contraction flow path 114, and is again expanded by the second expansion chamber 102B. Further, the exhaust gas generates the contraction flow in the communication path 110, is expanded by the isolation chamber 104 corresponding to the third expansion chamber, and is introduced to the inner pipe 92 from the opening portion 92C. Further, the exhaust gas introduced to the inner pipe 92 is discharged to the outlet pipe 38 through the rear end portion 92A of the inner pipe 92, that is, the gas discharge port 108, and is released into the atmosphere from the output pipe 38.

In this case, in the vehicle muffler 90, since the flat surface having a low rigidity is not formed while being formed as the flat shape in which the dimension H in the vertical direction is smaller than the dimension W in the muffler width direction as a whole, by arranging three isolation chambers 100, 102 and 104 which are isolated by the inter-isolation chamber joint 94B in the muffler width direction, in other words, since the inter-isolation chamber joint 94B intermittently or continuously joined approximately over a whole length in the longitudinal direction of the muffler shell 94 reinforces the muffler shell 94, the muffler shell 94 secures the surface rigidity of each of the portions (the first outer walls 18A and 20A and the second outer walls 18B and 20B constructing the isolation chamber 102 and the isolation chamber 104). Accordingly, in the vehicle muffler 90, the emission sound generated by the pass of the exhaust gas is suppressed.

Particularly, since the isolation chambers 102 and 104 (the space including the isolation chamber 100) is formed approximately as the columnar shape in the vehicle muffler 90, a circumferential length per volume (muffler volume) of the isolation chambers 102 and 104 is short in a cross sectional view which is orthogonal to the longitudinal direction. Accordingly, since the rigidities of the respective portions of the first outer walls 96A and 98A and the second outer walls 96B and 98B constructing the isolation chambers 102 and 104 become approximately uniform, in other words, since a partly low rigidity portion is not formed, the emission sound is effectively suppressed.

Further, particularly, in the vehicle muffler 90, since the inter-isolation chamber joint 94B is formed by joining the upper shell 96 and the lower shell 98 to the inner pipe 92, in other words, since the coupling, portion of the parallel arranged isolation chambers 102 and 104 is formed as the closed cross sectional structure, a rigidity is high as a whole of the muffler shell 94 in addition to each of the isolation chambers 100, 102 and 104. Accordingly, the muffler vibration caused by the support to the vehicle body by the muffler support may be effectively suppressed, for example, without depending on the base portion 46 coupling the first outer wall 96A and the first outer wall 96B.

Further, since the coupling portion of the closed cross sectional structure coupling the isolation chambers 102 and 104 mentioned above may be used as a muffler capacity, a required capacity may be secured without enlarging the height H. Accordingly, in the vehicle muffler 90, a whole length may be shortened, for example, in comparison with the vehicle muffler 10. Furthers in the vehicle muffler 90, since the contraction flow path 114 communicating the first expansion chamber 102A and the second expansion chamber 102B is provided so as to be biased to the end portion of the gas flow path, an expansion ratio, which is normally decided on the basis of the cross sectional shape which is orthogonal to the gas flow direction (a direction of an arrow L), is set on the basis of the cross section in the muffler longitudinal direction. Accordingly, in the present structure in which the flow path cross sectional area is constrained due to the provision of the isolation chamber 102 and the isolation chamber 104 corresponding to the approximately columnar space and arranged in parallel in the width direction, the expansion ratio may be set large and the noise reduction efficiency may be improved. Therefore, the constraint for obtaining a required noise reduction performance is reduced, and a freedom for designing the muffler is improved.

Further, in the vehicle muffler 90, since the muffler shell 94 is structured by the joint between the upper shell 96 and the lower shell 98 corresponding to the press worked product, the suppression of the emission sound is achieved by the simple structure while being flat and light. Further, since both the upper shell 96 and the lower shell 98 have the first outer walls 96A and 98A and the second outer walls 96B and 98B, the draw depth by the press working of the first outer walls 96A and 98A and the second outer walls 96B and 98B may be made shallow, and a formability is good. Further since the inter-isolation chamber joint 94B is formed by interposing the inner pipe 92 between the upper shell 96 and the lower shell 98, the draw depth by the press working of the first outer walls 96A and 98A and the second outer walls 96B and 98B may be made shallower than the upper shell 18 and the lower shell 20, and the formability of the upper shell 96 and the lower shell 98 by the press working is further improved.

Further, since the communication path 110 communicating the isolation chamber 102 and the isolation chamber 104 is provided in the muffler shell 94 in the vehicle muffler 90, the isolation chamber 102 and the isolation chamber 104 may be used as the independent expansion chambers which are continuous in the gas flow direction. Accordingly, the noise reduction performance of the vehicle muffler 90 may be secured. Further, since the communication path 110 is provided at the inter-isolation chamber joint 94B, that is, the joint between the coupling wall portion 96D and the coupling wall portion 98D, in other words, since the communication path 110 is arranged in the trough portion between the first outer wall 96A and the second outer wall 96B, the communication portion may be provided on the basis of the simple structure without increasing the height H (the thickness of the whole of the muffler) of the muffler shell 94.

In this case, with regard to the support to the vehicle body by the muffler support, the same effect as that of any one of the first to third exemplary embodiments may be obtained.

Eighth Exemplary Embodiment

Figure 15:
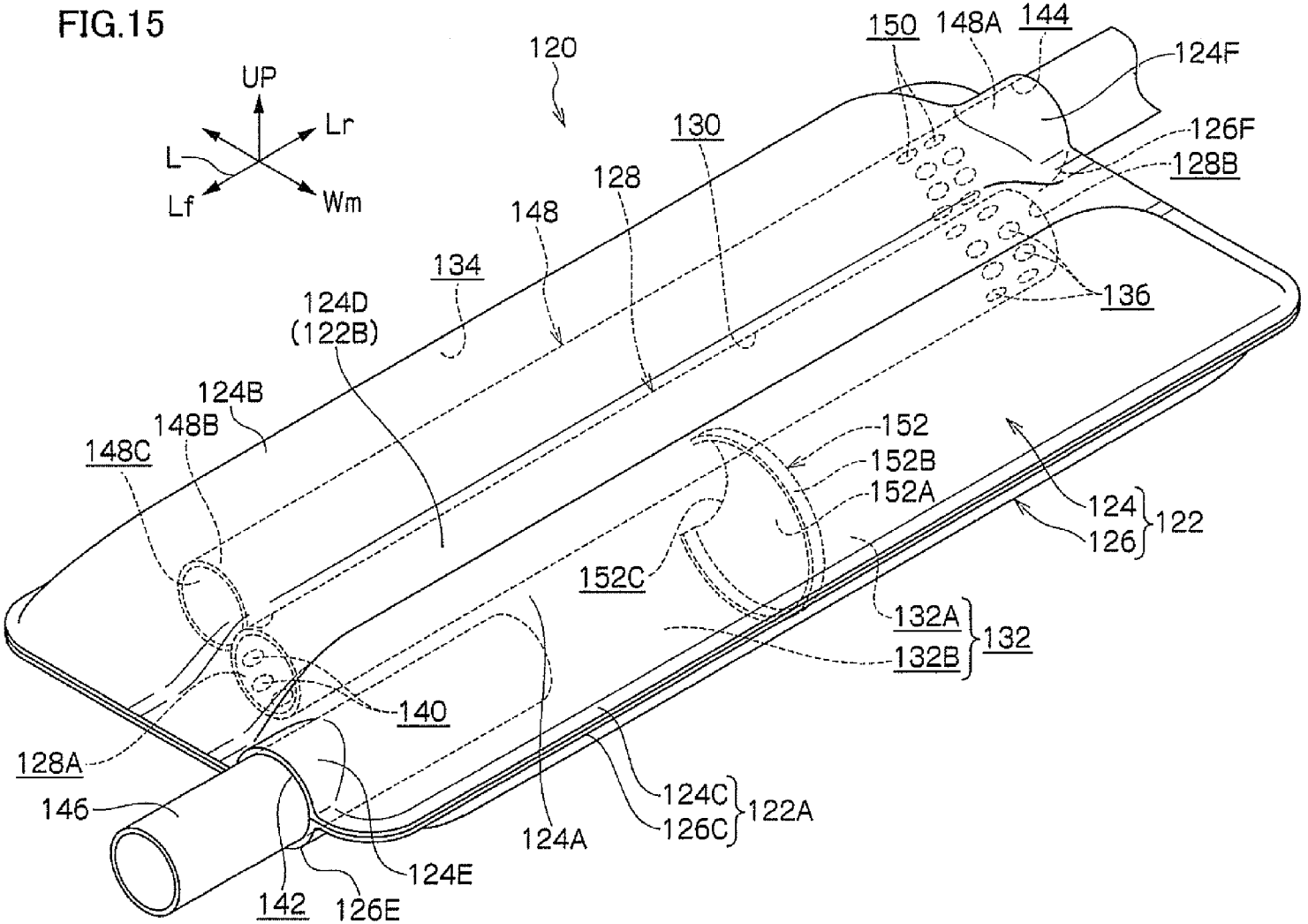
FIG. 15 is a perspective view of a muffler for a vehicle according to an eighth exemplary embodiment of the present invention.
Figure 16:
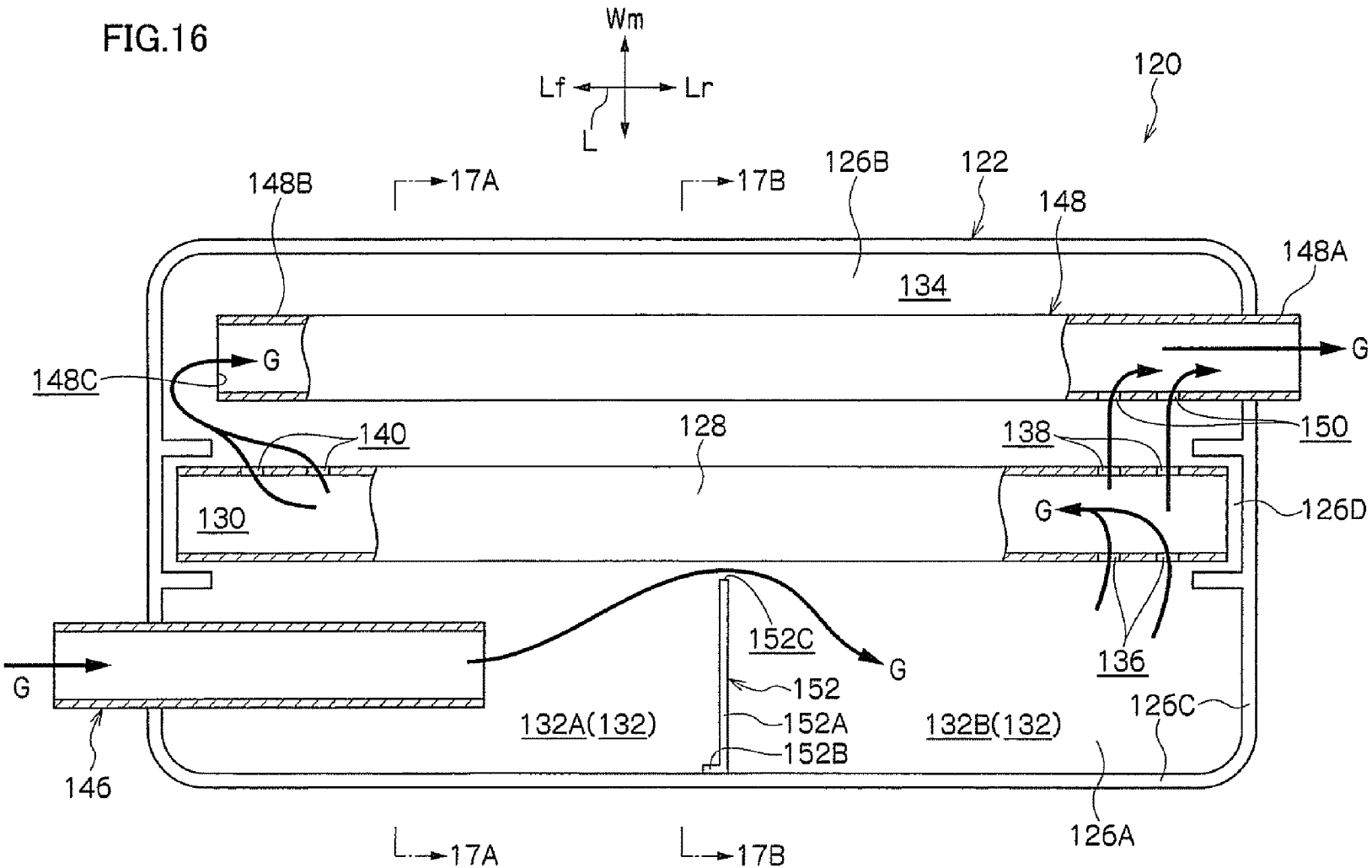
FIG. 16 is a plan cross sectional view of the muffler for the vehicle according to the eighth exemplary embodiment of the present invention.

FIG. 15 shows a vehicle muffler 120 in accordance with a eighth exemplary embodiment of the invention by a perspective view. Further, the vehicle muffler 120 is shown in FIG. 16 by a plan cross sectional view, and a cross sectional view alone a line 17A-17A in FIG. 16 and a cross sectional view along a line 17B-17B are respectively shown in FIGS. 17A and 17B. As shown in these drawings, the vehicle muffler 120 is similar to the muffler 90 in accordance with the seventh exemplary embodiment in that an upper shell 124 and a lower shell 126 constructing a muffler shell 122 are joined to an inner pipe 128 serving as a pipe member installed between the upper shell 124 and the lower shell 126, whereby an inter-isolation chamber joint 12213 is formed, but, a layout and a function of the inner pipe 128 are different from those of the inner pipe 92 in the vehicle muffler 90. A description will be given below specifically.

Figure 17A:
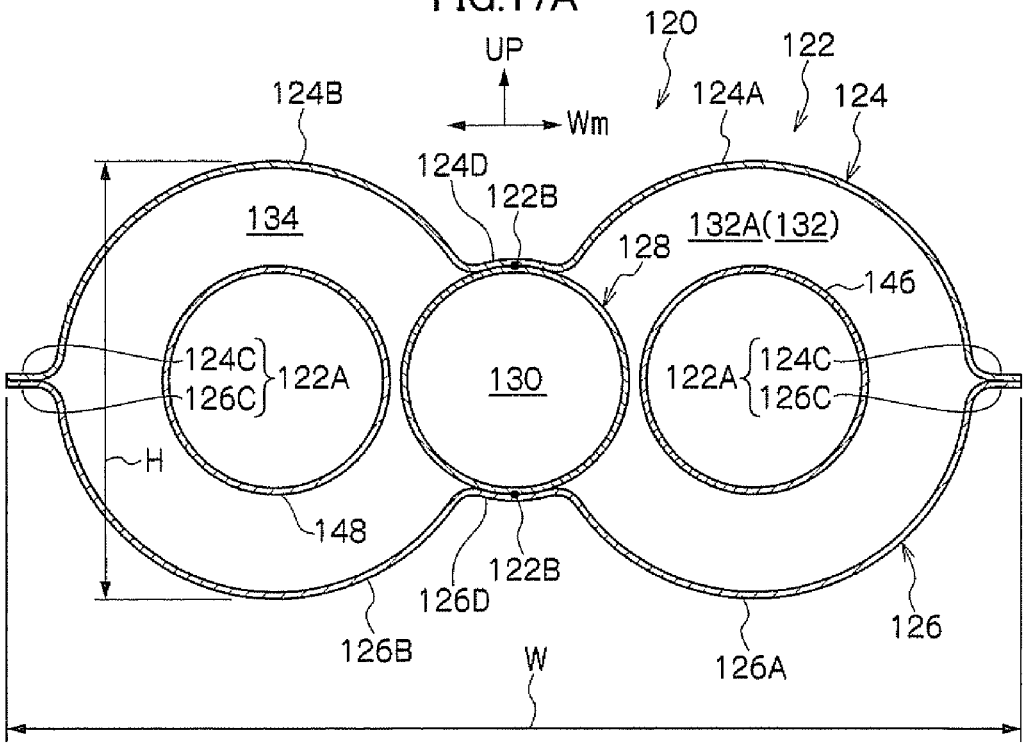
FIG. 17A is a cross sectional view along a line 17A-17A in FIG. 16.
Figure 17B:
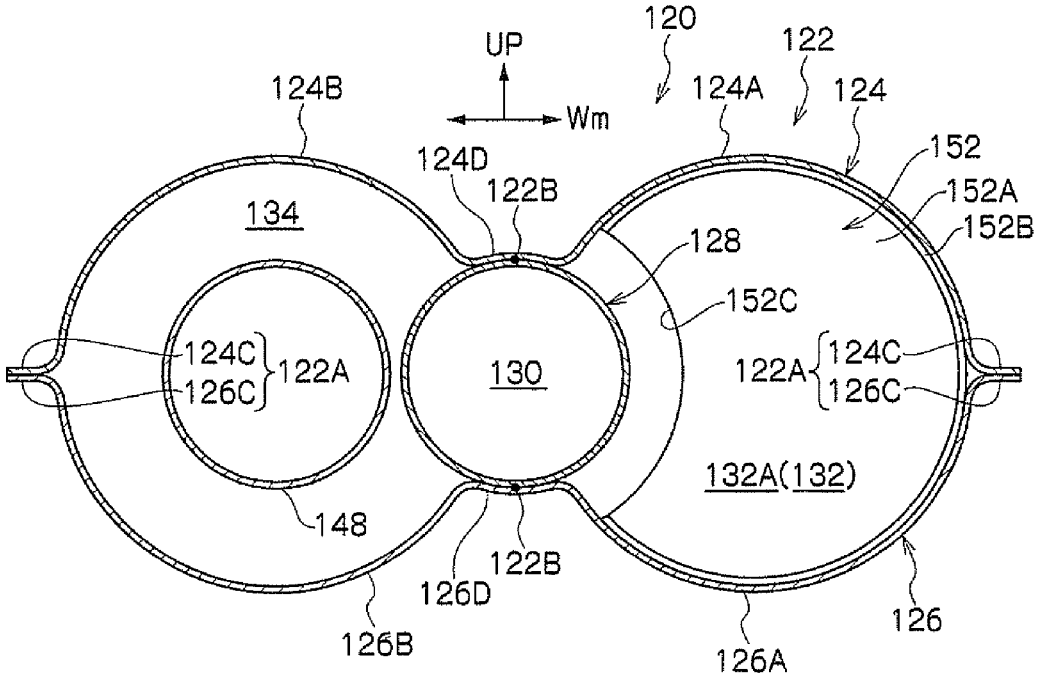
FIG. 17B is a cross sectional view along a line 17B-17B in FIG. 16.

As mentioned above, the muffler shell 122 is structured by joining the upper shell 124 and the lower shell 126. As shown in FIGS. 17A and 17B the upper shell 124 is structured such as to have a first outer wall 124A and a second outer wall 124B which are respectively formed as an approximately semi-cylindrical shape which is open to a downward side in a cross sectional view which is orthogonal to the longitudinal direction and are arranged in parallel in the muffler width direction, a peripheral joint flange 124C formed in such a manner as to surround a periphery of the first outer wall 124A and the second outer wall 1243, and a coupling wall portion 124D coupling open edges in an inner side of the muffler width direction of the first outer wall 124A and the second outer wall 124B.

The coupling wall portion 124D is positioned in an upper side than the peripheral joint flange 124C, and a depth of a space within the first outer walls 124A and 124B with respect to an open plane extending between the coupling wall portion 124D and the peripheral joint flange 124C is made shallower than a corresponding depth in the upper shell 18. Further, the coupling wall portion 124D is formed as a circular arc shape which is concaved to a lower side (the open side of the first outer wall 124A and the second outer wall 124B), and a curvature thereof corresponds to a curvature of the inner pipe 128.

The lower shell 126 is structured such as to have a first outer wall 126A and a second outer wall 126B which are formed as an approximately semi-cylindrical shape being open to an upward side and are arranged in parallel in the muffler width direction, a peripheral joint flange 126C formed in such a manner as to surround a periphery of the first outer wall 126A and the second outer wall 126B, and a coupling wall portion 126D coupling open edges in an inner side in the muffler width direction of the first outer wall 126A and the second outer wall 126B, in a cross sectional view being orthogonal to the longitudinal direction.

The coupling wall portion 126D is positioned in a lower side than the peripheral joint flange 126C, and a depth of a space within the first outer walls 126A and 12613 with respect to an open plane extending between the coupling wall portion 126D and the peripheral joint flange 126C is shallower than the corresponding depth in the lower shell 20. Further, the coupling wall portion 126D is formed as a circular arc shape which is concaved to an upper side (an open side of the first outer wall 126A and the second outer wall 126B), and a curvature of the coupling wall portion 126D corresponds to a curvature of the inner pipe 128.

The muffler shell 122 is structured such that a peripheral joint 122A is formed by joining the peripheral joint flange 124C of the upper shell 124 and the peripheral joint flange 126C of the lower shell 126, and the coupling wall portion 124D and the coupling wall portion 126D are away from each other in the vertical direction in a center section in the muffler width direction. In this muffler shell 122, a space formed at an inner side of the peripheral joint 122A is partitioned into isolation chambers 130, 132 and 134 which are formed long in the muffler front-rear direction and are arranged in parallel in the muffler width direction, by the inner pipe 128 arranged in the muffler front-rear direction. In this case, the isolation chamber 130 corresponds to an internal space of the inner pipe 128, and the isolation chambers 132 and 134 are positioned in both sides in the muffler width direction with respect to the isolation chamber 130.

Further, as shown in FIGS. 17A and 17B, the inner pipe 128 is arranged in the center section in the muffler width direction in the muffler shell 122. Specifically, the inner pipe 128 is sandwiched up and down in a surface contact state between the coupling wall portion 124D of the upper shell 124 and the coupling wall portion 126D of the lower shell 126, and the upper and lower contact portions are joined by a laser welding or the like, whereby the inter-isolation chamber joint 12213 is structured. The inter-isolation chamber joint 122B is structured such that the upper shell 124, the lower shell 126 and the inner pipe 128 are continuously or intermittently joined along the muffler front-rear direction.

As shown in FIGS. 15 and 16, front and rear ends of the coupling wall portions 124D and 126D are narrowed vertically so as to be connected to the peripheral joint flanges 124C and 126C (122A), whereby front and rear open ends 128A and 128B of the inner pipe 128 are substantially sealed. Further, a plurality of air introduction holes 136 communicating with an isolation chamber 132 (a second expansion chamber 132B mentioned below) and a plurality of exhaust holes 138 communicating with an isolation chamber 134 are provided near a rear end of the inner pipe 128. On the other hand, a plurality of exhaust holes 140 communicating with the isolation chamber 134 are provided near a front end of the inner pipe 128. A plurality of these air introduction holes 136 and exhaust holes 138 and 140 correspond to the communicating portion in the invention.

Further, as shown in FIG. 15, a gas introduction port 142 to which the exhaust gas is introduced, and a gas discharge port 144 discharging the exhaust gas are formed at the muffler shell 122. The gas introduction port 142 is open to a forward side in the muffler front-rear direction, and communicates a front end of the isolation chamber 132 and an outside of the muffler shell 122. The gas discharge port 144 is open to a backward side in the muffler front-rear direction, and communicates a rear end of the isolation chamber 130 and the outside of the muffler shell 122.

The gas introduction port 142 is formed by making non-joined portions between a gas introduction port forming portion 124E of the peripheral joint flange 124C and a gas introduction port forming portion 126E of the peripheral joint flange 1266C, the gas introduction port forming portion 124E being a portion positioned at a front side of the first outer wall 124A in the peripheral joint flange 124C of the upper shell 124 and formed as a semi-cylindrical shape which is open downward along a longitudinal direction, and the gas introduction port forming portion 126E being a portion positioned at a front side of the first outer wall 126A in the peripheral joint flange 126C of the lower shell 126 and formed as a semi-cylindrical shape which is open upward along the longitudinal direction. An insert pipe 146 is inserted (fitted) and fixed to the gas introduction port 142 so as to be coaxial with the isolation chamber 132. The insert pipe 146 is structured such that a front end is connected to the inlet pipe 34 (not shown), and a rear end is introduced into the isolation chamber 132(*a* first expansion chamber 132A mentioned below).

In the same manner, the gas discharge port 144 is formed by making non-joined portions between a gas introduction port forming portion 124F of the peripheral joint flange 124C and a gas introduction port forming portion 126F of the peripheral joint flange 126C, the gas introduction port forming portion 124F being a portion positioned at a front side of the first outer wall 124A in the peripheral joint flange 124C of the upper shell 124 and formed as a semi-cylindrical shape which is open downward along a longitudinal direction, and the gas introduction port forming portion 126F being a portion positioned at in a front side of the first outer wall 126A in the peripheral joint flange 126C of the lower shell 126 and formed as a semi-cylindrical shape which is open upward along the longitudinal direction.

The inner pipe 148 is arranged in an axial portion of the isolation chamber 134 along the longitudinal direction of the muffler shell 122, and a front end portion 148B thereof reaches a portion near the front end of the isolation chamber 134. More specifically, a front side opening portion 148C of the inner pipe 148 is open in a portion which is slightly rearward an exhaust hole 140 formed at the inner pipe 128 within the isolation chamber 134. A plurality of air introduction holes 150 are formed near the rear end portion 148A of the inner pipe 148 so as to be adjacent to a plurality of exhaust holes 138 formed at the inner pipe 128 (adjacent in the muffler width direction).

Each of the upper shell 124 and the lower shell 126 described above is integrally formed in respective portions by a press working of a metal thin plate. These upper shell 124 and the lower shell 126 may be formed by the same dies work. Further, the upper shell 124 and the lower shell 126 may be structured by making the portions along the longitudinal direction in the peripheral joint flange 124C and the peripheral joint flange 126C common (integral) and folding back the common portions. In this case, the upper shell 124 and the lower shell 126 may be integrally (simultaneously) formed. It should be noted that the upper shell 124 corresponds to the upper shell or the cover body in the present invention, and the lower shell 126 corresponds to the lower shell or the cover body in the present invention.

Further, a separator 152 partitioning the isolation chamber 132 back and forth is arranged within the isolation chamber 132 of the muffler shell 122. The separator 152 is structured such as to have a flat plate shaped partition plate portion 152A partitioning the isolation chamber 132 back and forth, and a ring-shaped fitting portion 152B provided at the partition plate portion 152A so as to be extended from a peripheral edge. The fitting portion 152B fitted to an inner periphery (the first outer walls 124A and 126A) of the isolation chamber 132 is fixed to the inner periphery of the isolation chamber 132 by a welding or the like, whereby the separator 152 is retained with respect to the muffler shell 122.

A first expansion chamber 132A corresponding to a space at a front side of the separator 152 in the isolation chamber 132 is communicated with a second expansion chamber 132B corresponding to a space at a rear side of the separator 152 in the isolation chamber 132 by a notch portion 152C formed at the separator 152 as shown in FIGS. 15 and 17B. The notch portion 152C of the separator 152 generates a contraction flow and an expansion in the passing gas flow, and is structured such that the noise reduction effect (mainly an effect of reducing a pulsation sound) is obtained.

In the vehicle muffler 120 described above, a configuration is provided such that the exhaust gas introduced to the isolation chamber 132 from the insert pipe 146 (the gas introduction port 142) reaches the second expansion chamber 132B by passing through the contraction flow path 152C of the separator 152 from the first expansion chamber 132A, and is introduced to the isolation chamber 130 serving as the third expansion chamber by further passing through a plurality of air introduction holes 136, as shown by an arrow G in FIG. 16. Further, a configuration is provided such that a portion of the exhaust gas that is introduced to the isolation chamber 130 is discharged from plurality of exhaust holes 138 and discharged to the inner pipe 148 from the plurality of introduction holes 150, and remaining portion of the exhaust gas that is introduced to the isolation chamber 130 is introduced to the inner pipe 148 by circulating through the isolation chamber 130 within the inner pipe 128 and passing through the exhaust holes and the front side opening portion 148C and passes through the inner pipe 148 to be discharged to the outlet pipe 38 from the gas discharge port 144.

The vehicle muffler 120 described above is structured such that the first outer wall 124A constructing the isolation chamber 132 and the second outer wall 124B constructing the isolation chamber 134 are supported to the vehicle body by the same structure as that of any one of the first to third exemplary embodiments although an illustration is omitted.

Explanation will now be given of the operation of the eighth exemplary embodiment.

In the vehicle muffler 120 having the structure mentioned above, the exhaust gas introduced from the inlet pipe 34 (the gas introduction port 142) is expanded by the first expansion chamber 132A, generates the contraction flow at a time of passing through the notch portion 152C of the separator 152, and is again expanded by the second expansion chamber 132B. Further, the exhaust gas generates the contraction flow in accordance with the pass through a plurality of air introduction holes 136 so as to be expanded by the isolation chamber 130 corresponding to the third expansion chamber, and is partly discharged from a plurality of discharge holes 138, and a residual part thereof is discharged from the exhaust hole 140. The exhaust gas discharged from a plurality of exhaust holes 138 is mainly introduced to the inner pipe 148 from a plurality of air introduction holes 150, and the exhaust gas discharged from the exhaust hole 140 is mainly introduced to the inner pipe 148 from the front side opening portion 148C of the inner pipe 148. Further, the exhaust gas introduced to the inner pipe 148 is discharged to the outlet pipe 38, and is released into the atmosphere from the output pipe 38.

In this case, in the vehicle muffler 120, since the flat surface having a low rigidity is not formed while being formed as the flat shape in which the dimension H in the vertical direction is smaller than the dimension W in the muffler width direction as a whole, by arranging three isolation chambers 130, 132 and 134 which are isolated by the inter-isolation chamber joint 122B in the muffler width direction, in other words, since the inter-isolation chamber joint 122B intermittently or continuously joined approximately over a whole length in the longitudinal direction of the muffler shell 122 reinforces the muffler shell 122, the muffler shell 122 secures the surface rigidity of each of the portions (the first outer walls 18A and 20A and the second outer walls 18B and 2013 constructing the isolation chamber 132 and the isolation chamber 134). Accordingly, in the vehicle muffler 120, the emission sound generated by the pass of the exhaust gas is suppressed.

Particularly, since each of the isolation chambers 130, 132 and 134 is formed approximately as the columnar shape in the vehicle muffler 120, a circumferential length per volume (muffler volume) of the isolation chambers 132 and 134 is short in a cross sectional view which is orthogonal to the longitudinal direction. Accordingly, since the rigidities of the portions of the first outer walls 124A and 126A and the second outer walls 12413 and 126B constructing the isolation chambers 132 and 134 become approximately uniform, in other words, since a partly low rigidity portion is not formed, the emission sound is effectively suppressed.

Further, particularly, in the vehicle muffler 120, since the inter-isolation chamber joint 122B is formed by joining the upper shell 124 and the lower shell 126 to the inner pipe 128, in other words, since the coupling portion of the parallel arranged isolation chambers 132 and 134 is formed as the closed cross sectional structure (the inner pipe 128), a rigidity is high as a whole of the muffler shell 122 in addition to each of the isolation chambers 130, 132 and 134. Accordingly, the muffler vibration caused by the support to the vehicle body by the muffler support may be effectively suppressed, for example, without depending on the base portion 46 coupling the first outer wall 124A and the first outer wall 124B.

Further, since the coupling portion of the closed cross sectional structure coupling the isolation chambers 132 and 134 mentioned above may be used as a muffler capacity, a required capacity may be secured without enlarging the height H. Accordingly, in the vehicle muffler 120, a whole length may be shortened, for example, in comparison with the vehicle muffler 10. Further, in the vehicle muffler 120, since the notch portion 152C of the separator communicating the first expansion chamber 132A and the second expansion chamber 132B is provided so as to be biased to the end portion of the gas flow path, an expansion ratio, which normally decided on the basis of the cross sectional shape which is orthogonal to the gas flow direction (a direction of an arrow L), is set on the basis of the cross section in the muffler longitudinal direction. Accordingly, in the present structure in which the flow path cross sectional area is constrained due to the provision of the isolation chamber 132 and the isolation chamber 134 corresponding to the approximately columnar space and arranged in parallel in the width direction, the expansion ratio may be set large and the noise reduction efficiency may be improved. Therefore, the constraint for obtaining a required noise reduction performance is reduced, and a freedom for designing the muffler is improved.

Further, in the vehicle muffler 120, since the muffler shell 122 is structured by the joint between the upper shell 124 and the lower shell 126 corresponding to the press worked product, the suppression of the emission sound is achieved by the simple structure while being flat and light. Further, since both the upper shell 124 and the lower shell 126 have the first outer walls 124A and 126A and the second outer walls 124B and 126B, the draw depth by the press working of the first outer walls 124A and 126A and the second outer walls 124B and 126B may be made shallow, and a formability is good. Further, since the inter-isolation chamber joint 122B is formed by interposing the inner pipe 128 between the upper shell 124 and the lower shell 126, the draw depth by the press working of the first outer walls 124A and 126A and the second outer walls 124B and 126B may be made shallower than the upper shell 18 and the lower shell 20, and the formability of the upper shell 124 and the lower shell 126 by the press working is further improved.

Further, since a plurality of air introduction holes 136, the exhaust hole 138 and the exhaust hole 140 for communicating the isolation chamber 132 and the isolation chamber 134 are provided in the inner pipe 128 in the vehicle muffler 120, the noise reduction performance may be adjusted on the basis of the dimension, the number and the layout thereof. In this exemplary embodiment, the noise reduction performance of the vehicle muffler 120 may be secured by using the isolation chamber 130 within the inner pipe 128 as the third expansion chamber. Further, since the isolation chamber 132 and the isolation chamber 134 are communicated by the inner pipe 128, the communication portion may be provided on the basis of the simple structure without increasing the height H (the thickness of the whole of the muffler) of the muffler shell 122. Although an illustration is omitted, the vehicle muffler 120 may obtain the exhaust sound reducing effect (refer to FIG. 10) equal to or more than that of the vehicle muffler 70 in accordance with the fifth exemplary embodiment.

In this case, with regard to the support to the vehicle body by the muffler support, the same effect as that of any one of the first to third exemplary embodiments may be obtained.

Ninth Exemplary Embodiment

Figure 18:
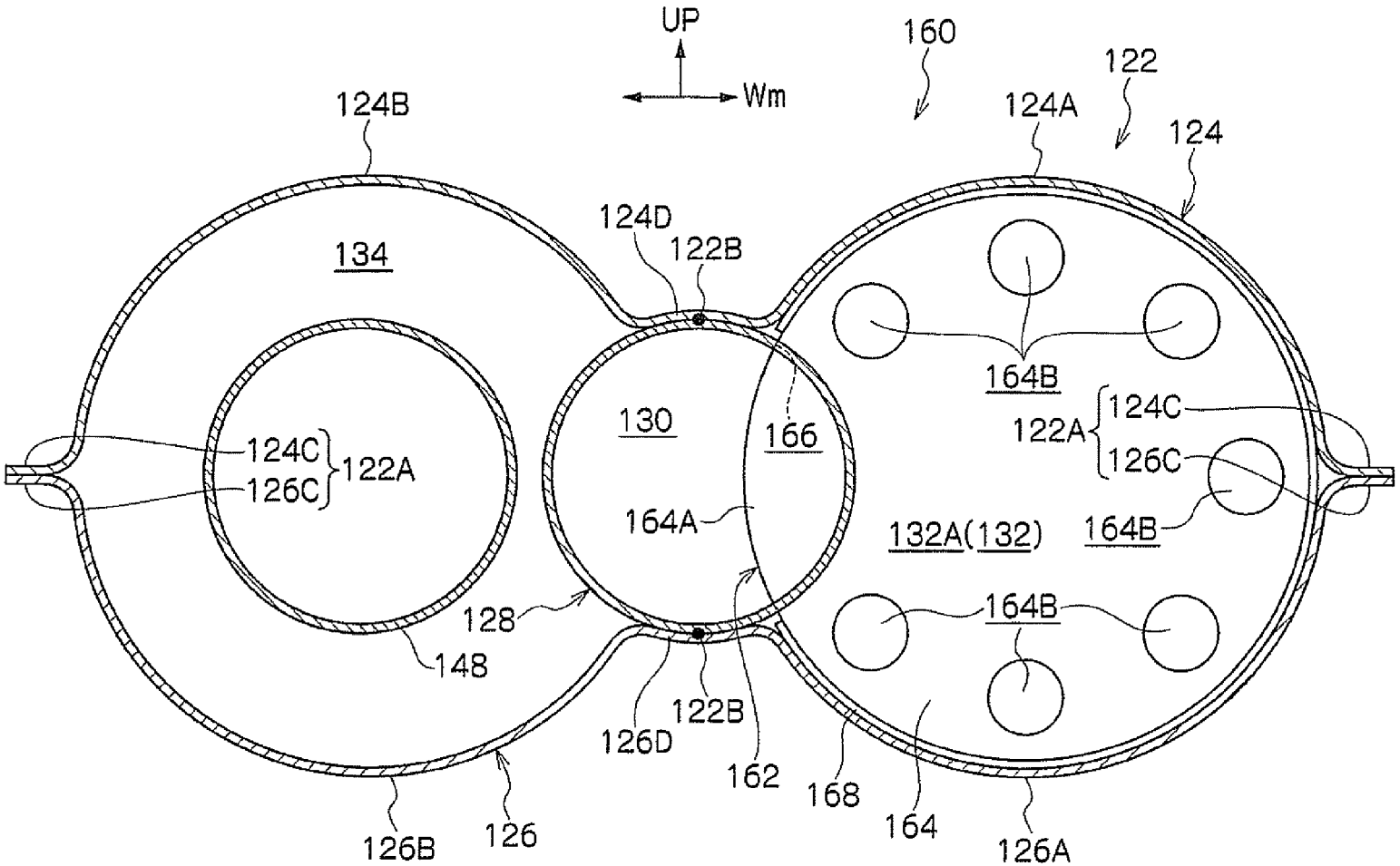
FIG. 18 is a cross sectional view corresponding to FIG. 17B and shows a muffler for a vehicle according to an ninth exemplary embodiment of the present invention.

FIG. 18 shows a vehicle muffler 160 in accordance with a ninth exemplary embodiment of the invention by a cross sectional view corresponding to FIG. 17B. As shown in this drawing, the vehicle muffler 160 is different from the vehicle muffler 120 in accordance with the eighth exemplary embodiment in a point that the vehicle muffler 160 is provided with a separator 162 partly protruding into the isolation chamber 130 in place of the separator 152.

The separator 162 has a disc-shaped partition plate portion 164 partitioning the isolation chamber 132 into the first expansion chamber 132A and the second expansion chamber 132B. The disc-shaped partition plate portion 164 is formed with a portion thereof being configured as a gate portion 164A protruding into the isolation chamber 130 through a slit 166 formed at a pipe wall of the inner pipe 128. The gate portion 164A is set such as to generate a contraction flow and an expansion in the gas flow passing through the isolation chamber 130 and obtain an effect of reducing the pulsation sound by damping of the sound energy of the passing exhaust gas, in conjunction with the setting of the dimension, the shape, the layout and the like of the air introduction hole 136, the exhaust holes 138 and 140 and the like. Accordingly, the shape of the gate portion 164A is not limited to be formed as the circular shape continuously with the other portions of the disc-shaped partition plate portion 164, however may be formed as various shapes in correspondence to the frequency band of the pulsation sound to be reduced (deadened) or the like.

The separator 162 is structured such as to have a ring-shaped fining portion 168 extended from a peripheral edge portion which does not interfere with the inner pipe 128 in the partition plate portion 164, and the fitting portion 168 fitted to an inner periphery (the first outer walls 124A and 126A) of the isolation chamber 132 is fixed to the inner periphery of the isolation chamber 132 by a welding or the like, whereby the separator 162 is retained to the muffler shell 122. Further, a plurality of through holes 164B communicating the first expansion chamber 132A and the second expansion chamber 132B are formed at the portion partitioning the isolation chamber 132 in the partition plate portion 164. A plurality of through holes 164B are constructed as a tuning element of the pulsation sound together with the gate portion 164A, the air introduction hole 136 and the exhaust holes 138 and 140.

The other structures of the vehicle muffler 160 are the same as the corresponding structure of the vehicle muffler 120.

Accordingly, on the basis of the vehicle muffler 160 in accordance with the ninth exemplary embodiment, the same effect may be obtained by the same operation as that of the vehicle muffler 120 in accordance with the eighth exemplary embodiment. Further, in the vehicle muffler 160, the gate portion 164A generating the contraction flow and the expansion in the exhaust gas passing through the isolation chamber 130 may be used as the tuning element of the exhaust sound. In other words, in the vehicle muffler 160, since the contraction flow and the expansion in the exhaust gas passing through the isolation chamber 130 may be used as the tuning element for reducing the pulsation sound, in addition to the tuning element for reducing the pulsation sound on the basis of the damping of the sound energy by the air introduction hole 136 or the like, the tuning width of the exhaust sound is wide, and the exhaust sound in the desired frequency band may be effectively reduced. Accordingly, in the vehicle muffler 160, the reducing effect of the exhaust sound including the pulsation sound may be made high, and the exhaust sound reducing effect (refer to FIG. 10) equal to or more than that of the vehicle muffler 70 in accordance with the fifth exemplary embodiment may be obtained. Further, since the gate portion 164A is arranged within the isolation chamber 130 only by assembling the separator 162, the reducing effect of the exhaust sound may be obtained without carrying out any after working such as the piercing or the like. Further, the exhaust sound reducing effect may be achieved without accompanying the increase of the parts number.

Tenth Exemplary Embodiment

Figure 19:
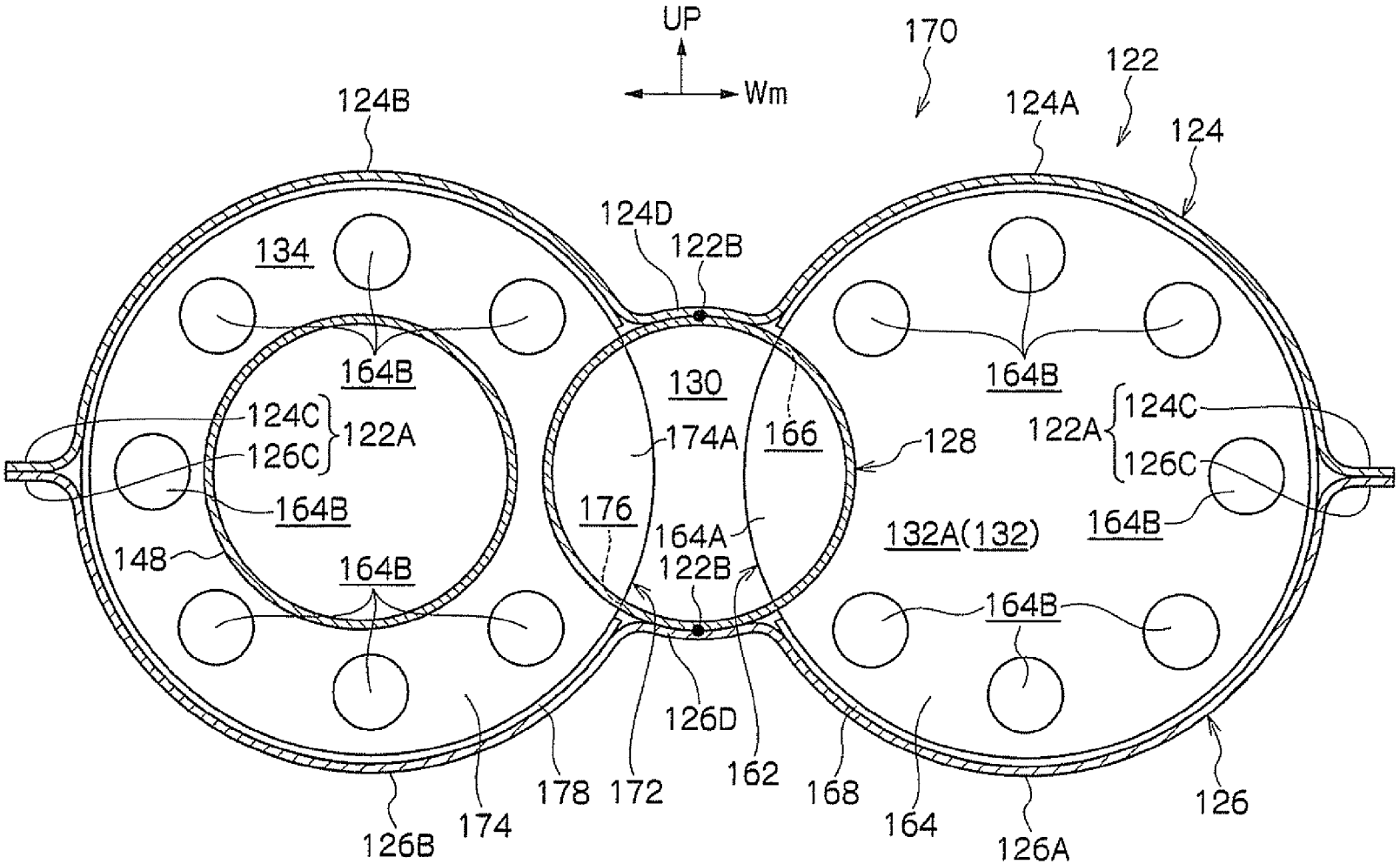
FIG. 19 is a cross sectional view corresponding to FIG. 17B and shows a muffler for a vehicle according to an tenth exemplary embodiment of the present invention.

FIG. 19 shows a vehicle muffler 170 in accordance with a tenth exemplary embodiment of the invention by a cross sectional view corresponding to FIG. 17B. As shown in this drawing, the vehicle muffler 170 is different from the vehicle muffler 160 in accordance with the ninth exemplary embodiment in a point that a separator 172 arranged within the isolation chamber 134 is provided in addition to the separator 162.

The separator 172 has an annular support plate portion 174 coupling an outer circumferential surface of the inner pipe 148 and an inner circumferential surface of the isolation chamber 134. The annular support plate portion 174 is formed with a portion thereof being configured as a gate portion 174A protruding into the isolation chamber 130 through a slit 176 formed at the pipe wall of the inner pipe 128. The gate portion 174A is set such as to generate a contraction flow and an expansion in the gas flow passing through the isolation chamber 130 together with the gate portion 164A and obtain a good noise reduction effect about the exhaust sound (mainly constituted by the pulsation sound) in the same manner as the ninth exemplary embodiment. Accordingly, the shape of the gate portion 174A is not limited to be formed as a circular shape continuously with the other portions of the disc-shaped support plate portion 174, however may be formed as various shapes in correspondence to a desired noise reduction effect. Further, the gate portion 174A may be aligned with the gate portion 164A at a position in the exhaust gas flow direction or may be offset.

Further, the separator 172 is structured such as to have a ring-shaped fitting portion 178 extended from a peripheral edge portion which does not interfere with the inner pipe 128 in the support plate portion 174, and the fitting portion 178 fitted to an inner periphery (the first outer walls 124A and 126A) of the isolation chamber 134 is fixed to the inner periphery of the isolation chamber 132 by the welding or the like, whereby the separator 172 is retained to the muffler shell 122 so as to support the inner pipe 148. Further, a plurality of through holes 174B allowing the exhaust gas to pass are formed at the portion partitioning the isolation chamber 132 in the support plate portion 174. A plurality of through holes 174B are set to a tuning element of the pulsation sound together with the dam portions 164A and 174A mentioned above, a plurality of through holes 164B, the air introduction hole 136, and the exhaust holes 138 and 140.

The other structures of the vehicle muffler 170 are the same as the corresponding structures of the vehicle muffler 160.

Accordingly, on the basis of the vehicle muffler 170 in accordance with the tenth exemplary embodiment, the same effect may be obtained by the same operation as that of the vehicle muffler 160 in accordance with the ninth exemplary embodiment. Further, since the dam portions 164A and 174A coming to the tuning element of the exhaust sound are provided respectively in two separators 164 and 174 in the vehicle muffler 170, the tuning width of the exhaust sound may be further widened.

In this case, in each of the exemplary embodiments mentioned above, there is shown the example in which the isolation chambers 12, 14, 100, 102, 104, 130, 132 and 134 are formed as the approximately columnar space, however, the invention is not limited to this. For example, a part or a whole of the isolation chamber may be formed as an oval columnar space or a rectangular columnar space.

Further, in each of the exemplary embodiments mentioned above, there is shown the example in which two or three isolation chambers are provided, however, the invention is not limited to this. For example, three or more outer walls (the first outer wall 18A and the like) are provided in each of the upper shells 18, 96 and 124 and the lower shells 20, 98 and 126 and the like so as to form a lot of isolation chambers.

DESCRIPTION OF REFERENCE NUMERALS

10 muffler for vehicle
12, 14 isolation chamber
16 muffler shell (muffler for vehicle)
18 upper shell (upper side shell)
18A first outer wall (outer wall)
18B second outer wall (outer wall)
20 lower shell (lower side shell)
20A first outer wall (outer wall)
20B second outer wall (outer wall)
26 communication path (communicating portion)
30 inner pipe
32 separator (support member)
42 muffler support (muffler support portion)
46 base portion (bridging member)
50, 55, 60, 70, 80, 90, 120, 160, 170 muffler for vehicle
52 muffler support (muffler support portion)
62 inner pipe
72 communication path (communicating portion)
82 communication path (communicating portion)
92, 128 inner pipe (pipe member)
94, 122 muffler shell (muffler for vehicle)
96, 124 upper shell (upper side shell)
96A, 124A first outer wall (outer wall)
96B, 124B second outer wall (outer wall)
98, 126 lower shell (lower side shell)
98A, 126A first outer wall (outer wall)

98B, 126B second outer wall (outer wall)
100, 102, 104, 130, 132, 134 isolating chamber
148 inner pipe
162, 172 separator
164A, 174A (part of separator)

The invention claimed is:

1. A muffler structure for a vehicle comprising:

an upper shell that has a plurality of outer walls formed in such a manner as to be open to a downward side in a vertical direction of a vehicle body and having a longitudinal axis in a gas flow direction; and a lower shell that has a plurality of outer walls formed in such a manner as to be open to an upward side in the vertical direction of the vehicle body and having a longitudinal axis in the gas flow direction, wherein the upper shell and the lower shell are directly joined at respective peripheral edge portions and a portion between the plurality of outer walls, to thereby form a plurality of isolation chambers which are arranged in parallel to a direction that crosses the gas flow direction, the plurality of isolation chambers communicating through a communicating portion that is provided at a joint position partitioning the plurality of isolation chambers, and the isolation chambers are formed as a columnar space having a longitudinal axis parallel to the gas flow direction.

2. A muffler structure for a vehicle comprising:

an upper shell having an outer wall formed longitudinally in a gas flow direction and formed so as to be open to a downward side in a in a vertical direction of a vehicle body;

a lower shell having an outer wall formed longitudinally in the gas flow direction and formed so as to be open to an upward side in the vertical direction of the vehicle body, and having a peripheral edge portion joined to a peripheral edge of the upper shell and forming a closed space at an inner side of a joint portion; and a pipe member formed longitudinally in the gas flow direction, joined to each of the outer wall of the upper shell and the outer wall of the lower shell, and partitioning the closed space into a plurality of isolation chambers which are arranged in parallel to a direction that crosses the gas flow direction, the plurality of isolation chambers communicating through a communicating portion that is provided at a joint position partitioning the plurality of isolation chambers.

3. The muffler structure for a vehicle according to claim 2, wherein a part of a plate-shaped separator partitioning at least one of the plurality of isolation chambers formed at an outer side of the pipe member in the gas flow direction is protruded to at least one of the isolation chambers within the pipe member.

4. The muffler structure for a vehicle according to claim 2, wherein the isolation chambers are formed as columnar space.

5. The muffler structure for a vehicle according to claim 1, wherein the communicating portion communicates between longitudinal direction end portions of the isolation chambers which are adjacent in a parallel direction.

6. The muffler structure for a vehicle according to claim 2, wherein the communicating portion communicates between longitudinal direction end portions of the isolation chambers which are adjacent in a parallel direction.

7. The muffler structure for a vehicle according to claim 1, further comprising an inner pipe which is located along the gas flow direction within at least one of the plurality of isolation chambers.

8. The muffler structure for a vehicle according to claim 2, further comprising an inner pipe which is located along the gas flow direction within at least one of the plurality of isolation chambers.

9. The muffler structure for a vehicle according to claim 7, wherein the inner pipe is supported at each of the upper shell and the lower shell by a support member.

10. The muffler structure for a vehicle according to claim 8, wherein the inner pipe is supported at each of the upper shell and the lower shell by a support member.

11. The muffler structure for a vehicle according to claim 1, further comprising a bridging member that bridges between the plurality of outer walls constituting different isolation chambers in the upper shell in a parallel direction of the plurality of isolation chambers, wherein a muffler support portion coupled to the vehicle body is constructed in the bridging member.

12. The muffler structure for a vehicle according to claim 2, further comprising a bridging member that bridges between the plurality of outer walls constituting different isolation chambers in the upper shell in a parallel direction of the plurality of isolation chambers, wherein a muffler support portion coupled to the vehicle body is constructed in the bridging member.

13. The muffler structure for a vehicle according to claim 11, wherein the bridging member is joined to the joint position partitioning the plurality of isolation chambers.

14. The muffler structure for a vehicle according to claim 12, wherein the bridging member is joined to the joint position partitioning the plurality of isolation chambers.

15. The muffler structure for a vehicle according to claim 11, wherein the bridging member constructing the muffler support portion is arranged at a center of gravity position of the muffler in a plan view.

16. The muffler structure for a vehicle according to claim 12, wherein the bridging member constructing the muffler support portion is arranged at a center of gravity position of the muffler in a plan view.

17. The muffler structure for a vehicle according to claim 1, further comprising a muffler support portion that is coupled to the vehicle body is provided at the joint position partitioning the plurality of isolation chambers.

18. The muffler structure for a vehicle according to claim 2, further comprising a muffler support portion that is coupled to the vehicle body is provided at the joint position partitioning the plurality of isolation chambers.

19. The muffler structure for a vehicle according to claim 1 wherein an axis of the communicating portion is perpendicular to the longitudinal axis.

20. The muffler structure for a vehicle according to claim 2 wherein an axis of the communicating portion is perpendicular to the longitudinal axis.

* * * * *